US010890001B2

(12) United States Patent
Hollmann

(10) Patent No.: US 10,890,001 B2
(45) Date of Patent: Jan. 12, 2021

(54) FORMWORK PANEL FOR CONCRETE-WORK SHUTTERINGS

(71) Applicant: Polytech GmbH, Bozen (IT)

(72) Inventor: Kai Hollmann, Costermano (IT)

(73) Assignee: Polytech GmbH, Bozen (IT)

( * ) Notice: Subject to any disclaimer, the term of this patent is extended or adjusted under 35 U.S.C. 154(b) by 0 days.

(21) Appl. No.: 16/672,848

(22) Filed: Nov. 4, 2019

(65) Prior Publication Data

US 2020/0063450 A1 Feb. 27, 2020

Related U.S. Application Data

(63) Continuation of application No. 14/903,971, filed as application No. PCT/EP2014/064721 on Jul. 9, 2014, now Pat. No. 10,465,397.

(30) Foreign Application Priority Data

Jul. 10, 2013 (DE) ..... 10 2013 107 303

(51) Int. Cl.

| | |
|---|---|
| ***E04G 9/05*** | (2006.01) |
| ***E04G 9/02*** | (2006.01) |
| ***E04G 11/38*** | (2006.01) |
| ***E04G 11/08*** | (2006.01) |
| *E04G 17/02* | (2006.01) |
| *E04G 11/50* | (2006.01) |
| *E04G 17/00* | (2006.01) |

(52) U.S. Cl.

CPC ..... *E04G 11/08* (2013.01); *E04G 9/05* (2013.01); *E04G 11/38* (2013.01); *E04G 11/50* (2013.01); *E04G 17/001* (2013.01); *E04G 17/02* (2013.01); *E04G 2009/028* (2013.01)

(58) Field of Classification Search

CPC ..... E04G 9/05; E04G 2009/028; E04G 9/02; E04G 11/06; E04G 11/08; E04G 11/38; Y10T 428/24777; Y10T 428/2457

USPC ..... 428/119, 167, 120, 192; 249/189, 196

See application file for complete search history.

(56) References Cited

U.S. PATENT DOCUMENTS

| | | | |
|---|---|---|---|
| 1,502,508 | A | 7/1924 | Longley |
| 2,297,899 | A | 10/1942 | Krueger |
| 2,953,836 | A | 9/1960 | Crook |
| 3,877,674 | A | 4/1975 | Cerutti |
| 4,030,694 | A | 6/1977 | Schimmel |
| 4,150,808 | A | 4/1979 | Sawyer |
| 4,886,234 | A | 12/1989 | Schworer |

(Continued)

FOREIGN PATENT DOCUMENTS

| | | |
|---|---|---|
| AT | 10946 | 1/2010 |
| CL | 200703214 | 11/2007 |

(Continued)

OTHER PUBLICATIONS

Office action for JP2019-149718 dated Sep. 14, 2020.

*Primary Examiner* — Michael Safavi
(74) *Attorney, Agent, or Firm* — Getz Balich LLC

(57) ABSTRACT

A formwork panel for concrete-work shutterings includes a supporting structure and a separate formwork skin connected to the supporting structure, characterized in that the supporting structure consists substantially of plastics material; and that the formwork skin, which is constituted by a single formwork skin element substantially of plastics material or by several formwork skin elements substantially of plastics material each, is releasably connected to the supporting structure.

16 Claims, 38 Drawing Sheets

(56) References Cited

U.S. PATENT DOCUMENTS

| | | | |
|---|---|---|---|
| 4,971,850 | A | 11/1990 | Kuan-Hong |
| 5,102,703 | A | 4/1992 | Colonel |
| 5,273,806 | A | 12/1993 | Lockshaw |
| 5,487,930 | A | 1/1996 | Lockshaw |
| 5,667,868 | A | 9/1997 | Freeman |
| 5,736,221 | A | 4/1998 | Hardigg |
| 5,807,618 | A | 9/1998 | Shiota |
| 5,849,393 | A | 12/1998 | Slattery |
| 7,469,873 | B2 | 12/2008 | Pegoraro |
| 2003/0193007 | A1 | 10/2003 | Wells |
| 2004/0261342 | A1 | 12/2004 | Hannawa |
| 2005/0120663 | A1 | 6/2005 | Pegoraro |
| 2007/0266669 | A1 | 11/2007 | Rapaz |
| 2009/0272876 | A1 | 11/2009 | McNamara |
| 2012/0286134 | A1 | 11/2012 | Rojas Pimienta |
| 2014/0302277 | A1 | 10/2014 | Van Der Horst |

FOREIGN PATENT DOCUMENTS

| | | | |
|---|---|---|---|
| DE | 3332406 | A1 | 3/1985 |
| DE | 102011007431 | A1 | 10/2012 |
| DE | 102011016120 | B4 | 5/2013 |
| EP | 1118735 | B1 | 5/2003 |
| EP | 2530214 | A1 | 12/2012 |
| EP | 2540933 | A1 | 1/2013 |
| JP | 4912204 | | 3/1974 |
| JP | 07171866 | | 7/1995 |
| JP | 09151602 | | 6/1997 |
| JP | H09156471 | A | 6/1997 |
| JP | 11336318 | | 12/1999 |
| JP | 2004251006 | A | 9/2004 |
| KR | 20040021388 | A | 3/2004 |
| KR | 200426196 | Y1 | 9/2006 |
| WO | 2011015660 | | 2/2011 |
| WO | 2014148716 | A1 | 9/2014 |

FORMWORK PANEL FOR CONCRETE-WORK SHUTTERINGS

This application is a continuation of U.S. patent application Ser. No. 14/903,971 filed Jan. 8, 2016, which is a PCT national stage application of PCT Application No. PCT/EP14/64721 filed Jul. 9, 2014, which claims priority to DE Patent Application No. 10 2013 107 303.4 filed Jul. 10, 2013.

BACKGROUND OF THE INVENTION

1. Technical Field

Subject matter of the invention is a formwork panel for concrete-work shutterings, comprising a supporting structure and a separate formwork skin connected to the supporting structure, characterized in that the supporting structure consists substantially of plastics material; and that the formwork skin, which is constituted by a single formwork skin element substantially of plastics material or by several formwork skin elements substantially of plastics material each, is releasably connected to the supporting structure.

The supporting structure may be a unitary plastics formwork panel. The single or the respective formwork skin element may be a unitary plastics molding.

2. Background Information

Formwork panels for concrete-work shutterings are known in a large variety of designs.

A distinction is expediently made between the categories "monolithic formwork panel" and "composite formwork panel". Monolithic formwork panels are unitary structures of throughout the same material. For example, there are known monolithic formwork panels of aluminum, monolithic plastics formwork panels and monolithic formwork panels of a welded steel construction.

Composite formwork panels mostly consist of a carrier grating (frame) and a formwork skin attached to the carrier grating on one side of the same. The carrier grating is the supporting component of the formwork panel, with carrier gratings of wooden beams, of steel beams or of aluminum beams being known. The formwork skin as a rule has a shorter lifetime than the carrier grating and, in particular due to wear, damage or fatigue, is replaced after a certain number of uses of the formwork panel. It is common praxis to attach the formwork skin to the carrier grating by means of screws or rivets. With known composite formwork panels, the formwork skin mostly consists of a multilayer plywood; however, there are also formwork skins known in the form of a composite construction of plywood layers/plastics layer or aluminum layer/plastic layers or glass fiber mats/plastic layers.

SUMMARY OF THE DISCLOSURE

In case of the composite formwork panel according to the invention, both the supporting structure consists substantially of plastics material and also the single formwork skin element or the respective several formwork skin elements consist substantially of plastics material. The supporting structure may consist of plastics material throughout. The single formwork skin element or the several formwork skin elements may each consist completely of plastics material. With respect to the supporting structure, it is advantageous to utilize fiber-reinforced plastics material, wherein "short fibers", i.e. in the meaning of this term in the present application fibers having in the average a length of less than/equal to 1 mm or "long fibers", i.e. in the meaning of this term in the present application fibers having in the average a length of more than 1 mm, can be employed (fibers having in the average a length of several millimeters are very well possible). As regards the single formwork skin element or the several formwork skin elements, it is advantageous to utilize plastics material that is reinforced by means of "short fibers" and/or mineral particles, e.g. calcium carbonate, talcum or other known particles. Both in the supporting structure and in the formwork skin, there can also be used other reinforcing means.

The term "separate" in the first paragraph of the description is to point out that the supporting structure and the single formwork skin element or the several formwork skin elements each have been manufactured individually and thereafter have been combined into the formwork panel. Statements further below will demonstrate still more clearly that, due to the separate manufacture of the supporting structure, there are possibilities opened for designing this portion of the formwork panel through which, in terms of manufacturing technology, a supporting structure and thus a formwork panel in total can be achieved which is of considerably higher strength than e.g. a monolithic plastics formwork panel.

The term "releasably", as mentioned in the first paragraph of the description (which alternatively could also be defined as "detachably") is to point out that a type of connection is employed which allows the single formwork skin element or each of the the several formwork skin elements to be removed again from the supporting structure. Preferably, such removal is to be possible with little working expenditure involved. Preferably, it is to be possible that the supporting structure, from which the formwork skin has been removed, permits further use of the same in that a new single formwork skin element or several new formwork skin elements are attached to the same. The single formwork skin element removed from the supporting structure or the several formwork skin elements removed from the supporting structures can each be recycled without any problem as they are at least substantially uniform as regards the material of the same.

The formwork panel according to the invention can be designed such that the front side of the formwork skin, i.e. the formwork skin surface establishing contact with the pulpy concrete, is free from the presence of formwork panel constituent parts related to the connected state of the formwork skin to the supporting structure. For, if such formwork panel constituent parts were present on the front side of the formwork skin, they would show in the finished concrete, which the formwork panel according to the invention desires to avoid. In other words: the connection of the formwork skin to the supporting structure expediently is effected only on the rear side of the formwork skin. For example, if screws are used for connecting the formwork skin to the supporting structure, it is advantageous to use a design in which the screws are inserted from the rear side of the formwork panel.

The expression "substantially of plastics material", as used three times in the first paragraph of the description, has been chosen to avoid the risk that the very subordinate use of other materials—as measured in relation to the overall volume of the supporting structure or the formwork skin—, for example of metal pins molded into the plastics material or metallic reinforcing corners, could have the result that such formwork panels are outside of the scope of protection of claim 1.

As already pointed out hereinbefore, the formwork skin of a formwork panel is subject to aging. There is wear when concrete pulp is poured in and when the formwork panel is removed from the solidified concrete; there is a certain amount of fatigue of the material due to the changing stress (stress due to the concrete pressure/stress relief upon removal of the formwork panel); and, as experience shows, there is every now and then damage caused during transport to the building site, transport at the building site, during handling and so on. This is why the formwork skin has to be replaced after a certain number of uses of the formwork panel, which is possible in particularly unproblematic manner in the light of the structure of the formwork panel according to the invention.

The formwork panel according to the invention achieves a considerable number of advantages in combination:

(1) When a weight limit of 25 kg is set for the formwork panel so that it can be moved by hand without any problem, there are nevertheless still sufficiently large formwork panels feasible to permit shutterings or formwork systems to be erected and disassembled efficiently.

(2) The formwork panel according to the invention can be designed for a concrete pressure of up to 40 kN/m$^2$, when more material is used, it may also be designed for a concrete pressure of up to 50 kN/m$^2$ or 60 kN/m$^2$. The formwork panel can be designed such that it does not bend more under the maximum design concrete pressure than is permitted according to DIN 18202, which makes a distinction according to classes of planarity for different concrete products. A merely small degree of bending of the formwork panel ensures that an as plane as possible concrete appearance is achieved in the overall concrete product.

(3) In the formwork panel according to the invention, the plastics formwork skin may be of abrasion-resistant, scratch-resistant and shock-resistant design. There are no problems as regards the absorption of water. The formwork skin detaches easily from the concrete upon removal of the formwork panel.

(4) The formwork panel according to the invention provides optimum conditions for permitting adjacent formwork panels to be arranged with sufficiently aligned front sides in a common plane and good, closely packed positioning (little penetration of concrete slurry).

(5) Plastics material is less expensive and easier to process and more durable than many other materials.

(6) The simple replaceability of the formwork skin and the non-visibility of marks of parts of connecting elements of formwork skin/supporting structure has already been pointed out hereinbefore.

There is quite a number of plastics molding processes that can be used in the manufacture of the supporting structure and/or the formwork skin elements. As processes well suited for the formwork panel according to the invention, there can be named plastics injection molding, plastics compression molding (introduction of plastics grains or also plate-like precursors or so-called preforms into a split mold, heating the mold for melting the plastics material or for thermal curing of the plastics material, cooling of the mold for allowing thermoplastic plastics material to solidify), thermoforming (a plate or a film of thermoplastic plastics material is heated and pressed into a cooled mold or mold half, or sucked into the same using vacuum pressure), and plastics extrusion.

The supporting structure is a component having a comparatively complex shape. It is particularly expedient to design the supporting structure as a—substantially or completely—integral injection-molded component of plastics material. The embodiments described further below will demonstrate still more clearly that it is possible in particular in case of an injection-molded component to achieve a configuration of the supporting structure that is advantageous in terms of load bearing capacity, durability and appearance of the supporting structure. It is expressly pointed out that it can be seen from the finished component when the same is an injection-molded component, especially from the relatively small wall thicknesses, the relatively small radii, the finely modeled shape, the sprues and so on. The supporting structure may be an injection-molded component the form of which permits the conclusion that it was actually formed by injection molding.

As an alternative, it is advantageous when the supporting structure—substantially or completely—is an integral compression-molded component of plastics material. The supporting structure may be a compression-molded component the form of which permits the conclusion that it was produced by compression-molding.

It is advantageous when there is provided at least one formwork skin element which—substantially or completely—is an integral injection-molded component of plastics material. This formwork skin element may be a component the form of which permits the conclusion that it was produced by injection-molding. The formwork skin element or elements are components which as a rule have a less complex configuration than the supporting structure.

Furthermore, it is advantageous as an alternative when there is at least one formwork skin element present which—substantially or completely—is an integral compression-molded component of plastics material. This formwork skin element may be a component the form of which permits the conclusion that it was produced by compression-molding of plastics material.

The particular formwork skin element often is substantially plate-like with molded-on extensions for specific purposes, as explained further below in more detail, but it may also have distinct reinforcing ribs for reducing local formwork skin bending.

The following paragraphs (1), (2) and (3) describe expedient, more concrete design possibilities for the supporting structure:

(1) The supporting structure may be an integral structure that comprises walls or at least substantially consists of walls. Regarding the formwork panel, which comprises the supporting structure and the at least one formwork skin element connected to the same, the walls may have a "height extension" extending at right angles to the formwork skin front side, and a "longitudinal extension" extending along the formwork skin rear side as well as a wall thickness measured at right angles to their "longitudinal extension". The wall height measured at right angles to the formwork skin front side may be uniform throughout, but does not have to be uniform throughout. The longitudinal extension, among others, may be rectilinear, rectilinear in sections with angles in between, continuously curved or curved in sections. The structure comprising walls or consisting at least substantially of walls may have four peripheral walls (these are the walls closest to the four edges of the formwork panel) as well as one or more intermediate walls arranged less closely to the edges of the formwork panel. In addition to the walls, the supporting structure may have additional material portions, in particular plate-like material portions extending on the rear side of the supporting structure.

(2) The supporting structure may comprise one double wall or a plurality of double walls the two (partial) walls of which on the rear side (the side remoter from the formwork skin) of the supporting structure are (each) connected to each other at least substantially along the length of the double wall in continuous manner by a material portion, or in sections by individual material portions, or predominantly consist of such double walls or entirely consist at least substantially of such double walls. The statements in preceding paragraph (1) concerning the wall height extension, the wall height, the wall longitudinal extension and the wall thickness apply analogously also for each of the respective two partial walls and for the respective double wall. The expression "at least substantially in continuous manner" is to point out that minor interruptions, e.g. for continuous channels from the front side to the rear side of the supporting structure for the passage of tie anchors or for the passage of mechanical connection means for the supporting structure/formwork skin connection, do not alter the fact that a "substantially continuous" connection between the two partial walls of the respective double wall is established. The design may be such that—as seen in the cross-section of the respective double wall—there is created an at least substantially U-shaped configuration or a substantially hat-shaped configuration to be described in more detail further below, which allows a particularly advantageous supporting or bearing behavior of the supporting structure to be achieved. On the front side of the supporting structure, these double walls may be open, thus providing for good production properties.—The design disclosed in paragraph (2) may be combined with one or several ones of the features disclosed in paragraph (1). In particular, the design with four peripheral walls and one or more intermediate walls is cited here, wherein either a partial number of the entirety of peripheral walls and intermediate wall or walls, or just a partial number of the peripheral walls or all peripheral walls, and/or just a partial number of the intermediate walls are all intermediate walls, or all walls of the entirety of peripheral walls and intermediate wall or walls may be designed as double wall or double walls of the type described.

(3) The supporting structure may be designed such that it has at least one through-opening extending continuously from its front side to its rear side. This feature excludes supporting structures having a continuous plate-like design on the rear side thereof. Advantageously, there are provided several such openings in a distribution across the overall plan view area of the supporting structure that is expedient for the stability of the supporting structure and the formwork panel, respectively (the distribution may, but does not necessarily have to be more or less uniform), in particular more than 5 openings or more than 10 openings or more than 20 openings. The openings improve the ratio between load bearing capacity and weight of the supporting structure. In case of only one opening, the size of the area in plan view may be at least 20%, better at least 30%, of the overall plan view area of the supporting structure. In case of several openings, the sum of the area sizes of the openings may be more than 40%, better more than 50%, of the overall plan view area of the supporting structure. The aforementioned opening or openings each expediently have an area size in plan view which, at least for the predominant part of the openings, is more than 25 $cm^2$, better more than 50 $cm^2$, and thus is greater than the size of channels extending from the supporting structure front side to the supporting structure rear side for other purposes, e.g. for the passage of tie anchors or the passage of mechanical connection means for the supporting structure/formwork skin connection. At least part of the aforementioned openings may be surrounded in part or completely by a wall as described in paragraph (1) or by a double wall as described in paragraph (2).—The design disclosed in paragraph (3) may be combined with one or more of the features disclosed in paragraph (1) and/or with one or more of the features disclosed in paragraph (2).

A good possibility consists in forming the supporting structure substantially as a grating. A grating design creates optimum conditions for supporting the formwork skin by the supporting structure in comparatively small "supporting intervals", so that the formwork skin can be dimensioned comparatively thin while nevertheless affording a sufficient load bearing capacity. Advantageously the supporting distances are throughout smaller than 25 cm, better smaller than 20 cm and still better smaller than 15 cm. In a particularly advantageous embodiment, the walls, i.e. four peripheral walls and a considerable number of intermediate walls, are designed at least in part (and expediently all) as double walls. At least part of the double walls (expediently all of the double walls) of the intermediate walls can be designed such that the two (partial) walls on the rear side (the side remoter from the formwork skin) of the supporting structure are each connected by material portions such that—as seen in cross-section of the respective double wall—there is created a U-shaped configuration or a hat-shaped configuration to be described in more detail further below, which allows a particularly advantageous supporting behavior of the supporting structure to be achieved. On the front side of the supporting structure, these double walls may be open, thus providing for good production properties.

As regards the intermediate double walls, the connected state mentioned of the two partial walls may be such that, possibly apart from the channels to be described further below and extending at right angles to the formwork panel front side, the interstices or spaces between the two partial walls on the formwork panel rear side are each closed continuously towards the outside by the material portions. In case of the peripheral double walls—for reasons that will become clearer further below—, a connection of the two partial walls can be provided each by a series of spaced-apart "connecting bridges" both on the front side and on the rear side of the supporting structure.

In the more concrete embodiments disclosed in paragraphs (1) and (3) hereinbefore, it is possible that the supporting structure is not designed substantially as a grating, i.e. the design substantially as a grating is excluded by way of a disclaimer that is expressly disclosed herewith.

Particularly advantageous types of connection in the present invention for connecting the formwork skin (i.e. the single formwork skin element or each of the several formwork skin elements) to the supporting structure are: by means of screws and/or rivets and/or clip-type connections and/or fused or caulked enlarged portions on molded-on connecting pins and/or releasable adhesive connection(s). The term "clip-type connections" comprises in particular connections with resilient tongues having portions latching behind counter-elements, which in technical language are also referred to as snap fit, as well as connections having projecting portions (advantageously: only slightly projecting) that are press-fitted into recessed counter-portions (advantageously: only slightly recessed); reference is made here also to the embodiments. The average expert knows how to connect two plastics components by means of a releasable adhesive connection. For releasing the adhesive connection, there is e.g. the possibility of making use of selective solvents.

It is expressly emphasized and expressly disclosed herewith that subject matter of the invention also is a formwork panel for concrete-work shutterings that has the features indicated in the first paragraph of the description, however without the adjective "releasable". This formwork panel may comprise one or more of the more specific features disclosed in the application. There are possible concrete-work wall shutterings as well as concrete-work ceiling shutterings in which such formwork panels are provided. The manufacturing methods disclosed in the application also apply to these formwork panels in corresponding manner. For example, it is possible in particular to connect the formwork skin to the supporting structure by welding. Such a connection can be undone at the most with considerable expenditure such that at least the supporting structure may be reused.

It is advantageous in the scope of the invention when at least one formwork skin element has at least one or several molded-on extensions having a function in transferring possible tensile forces between the supporting structure and the particular formwork skin element (and naturally vice versa). In the formwork panel according to the invention, tensile forces are understood to be forces acting at right angles to the formwork skin front side. The tensile forces occur in particular when the formwork panel is pulled off from the solidified concrete of a concrete product manufactured. The tensile forces mentioned may also be force components of forces which in total have a different direction. The extension (or extensions) in particular may be an extension adapted to have screws threadedly engaged therein. The extension (or extensions) in particular may be an extension for a connection of the type "projecting portion is seated in recessed portion", as already mentioned hereinbefore.

It is advantageous in the scope of the invention when there is at least one formwork skin element that uses a positive female/male engagement with the supporting structure in at least one location or in several locations, so that possible shear forces acting parallel to the formwork skin front side are transferred between the respective formwork skin element and the supporting structure (and naturally vice versa). The female/male engagement can each be constituted by one or more extensions molded on this formwork skin element and engaging in a receiving portion formed in the supporting structure. It is expedient in this regard when the respective extension is arranged in the respective receiving portion substantially without play in the lateral direction.

An expedient possibility of realizing the positive female/male engagement (at least in one location or in several locations in at least one formwork skin element) consists in providing the formwork-skin-facing end portion of at least one wall, better several walls or all walls provided in the supporting structure continuously or in sections with a series of extensions and recesses, e.g. of the type of teeth of a toothed rack. In this case, the rear side of the formwork skin, in those portions where end portions of the supporting structure walls are in engagement with the formwork skin, is provided at least with partial sequences of extensions and recesses, e.g. of the type of teeth of a toothed rack. In the engagement portions, extensions of the respective wall of the supporting structure engage in recesses of the formwork skin, and extensions of the formwork skin engage in recesses of the respective wall of the supporting structure in the form of a mutually complementary engagement. In case of a system of walls extending in several directions, in particular in case of a system of crossing walls, the shear strength of the engagement between supporting structure and formwork skin is not restricted to one direction only (of the numerous directions possible parallel to the formwork skin front side). The walls may be double walls, in particular as described hereinbefore, but may also be walls of different design, in particular as described hereinbefore.

Due to the aforementioned positive engagement situation or situations, an immediate shear force transfer between the supporting structure and the respective formwork skin element and vice versa is ensured. In other words: due to the positive engagement situation or situations, the respective formwork skin element and the supporting structure are united such that they constitute an at least largely commonly supporting structure. In this manner, it is possible to save material in the supporting structure.

It is advantageous in the scope of the invention when, in the formwork skin element mentioned in the two preceding paragraphs, there are several locations using an extension/recess engagement and when at least a partial number of these engagement extensions at the same time constitutes an extension or extensions which also has/have a function in transferring possible tensile forces between the supporting structure and the respective formwork skin element. With these double function extensions, the function of mounting formwork skin element/supporting structure with tensile strength and the function of a direct shear force transfer are thus provided at the same location, which also enhances the material balance.

However, on the other hand, it is also possible in the scope of the invention to provide the locations for the releasable connections between the respective formwork skin element and the supporting structure as well as the locations for the possibility of the direct shear force transfer in different positions, which involves the advantage that it is possible more easily to make the releasable connections easily accessible from the rear side of the formwork panel, which makes itself felt in advantageous manner when the formwork panel is disassembled for replacing the formwork skin.

It is advantageous in the scope of the invention when the plastics material of the supporting structure is of higher strength than the plastics material of the single formwork skin element or the plastics material or materials of the several formwork skin elements. The supporting structure may be designed such that it creates the major part of the total strength of the formwork panel, whereas the formwork skin creates only a lesser part of the total strength in the formwork panel. In this case, it is acceptable that the at least one formwork skin element consists of a plastics material of lesser strength. As regards the plastics material of the supporting structure, it is advantageous to use a fiber-reinforced plastics material, with glass fibers or carbon fibers constituting especially expedient possibilities and wherein not only short fibers (with a length of less than/equal to 1 mm), but also longer fibers, e.g. with a length of several millimeters, are conceivable. It is advantageous in the formwork skin element mentioned to provide either a fiber reinforcement with comparatively short fibers or a reinforcement with particles, in particular mineral particles such as calcium carbonate particles and talcum particles. As regards the formwork skin element mentioned, it is not maximum strength that is in the foreground according to the invention, but rather good surface quality for good concrete surfaces, good recycling possibilities and a favorable price.

It is advantageous in the scope of the invention when the plastics material of at least one formwork skin element is selected such that the formwork skin element is nailable. With formwork panels there is quite often the situation present that e.g. block-like parts or beam-like parts (which then cause recesses or perforations, also referred to as cavities, to be formed in the concrete) or formwork angle pieces (for forming a terminating edge of the concrete product, which is also referred to as stopend or stopend formwork) are to be attached by nailing. The nailability referred to at the beginning of this paragraph can be defined such that a nail having a diameter of 3 mm can be driven in, without visible cracks being formed around the nailing location. In this event, the nail can be withdrawn again later on, and the nail hole substantially closes again with concrete slurry during the next concrete-work application and as a rule stays closed. Plastics materials of lesser strength than the plastics material of the supporting structure, as described hereinbefore, can be provided in a nailable design more easily. Glass fibers as a rule clearly aggravate the nailability.

It is advantageous in the scope of the invention when the supporting structure, on the two longitudinal sides and/or on the two transverse sides of the same, each has a wall-like, in particular a double-wall-like design with a number of wall openings, in particular wall-crossing openings. These openings can be used expediently for reaching into the same during handling of the formwork panel and for connecting adjacent formwork panels.

The wall openings mentioned as well as the regions around the same may be designed such that mechanical coupling elements for coupling adjacent formwork panels and/or shuttering accessories, such as push-pull props or formwork brackets, can be connected or attached there in expedient manner. It is possible in the supporting structure according to the invention to provide for sufficient stability at these locations.

It is advantageous in the scope of the invention when the formwork panel, in plan view, has an area of at least 0.8 $m^2$, preferably at least 1.0 $m^2$. Due to the type of construction according to the invention, it is possible to easily make available formwork panels of this size with a concrete pressure absorption capacity of up to 40 $kN/m^2$, or also up to 50 $kN/m^2$ or also up to 60 $kN/m^2$, without involving excessive formwork panel bending or without excessive use of material and thus excessive weight.

As plastics materials for the supporting structure and/or the formwork skin elements it is expedient to use thermoplastic plastics materials each, however, the use of thermosetting plastics materials is possible as well.

The preceding explanation in several locations uses the expression "at least one formwork skin element". In the event of a formwork skin consisting of a single formwork skin element, this single formwork skin element is meant, whereas when the formwork skin is constituted of several formwork skin elements, this is to point out that at least one of these several formwork skin elements is designed as indicated. However, it is particularly advantageous when several formwork skin elements each or all formwork skin elements provided in the formwork panel are designed accordingly. This applies for each of the locations making use of the expression "at least one formwork skin element". Taken as a whole, the case in which the formwork skin is formed of one single formwork skin element is the most advantageous one.

An immense advantage of the formwork panel according to the invention consists in that it may be designed such that one and the same formwork panel can be utilized selectively either for erecting a wall shuttering or for erecting a ceiling shuttering. The term "wall shuttering" in the present application includes also shutterings for columns.

A further subject matter of the invention is a wall shuttering for concrete-work, which comprises several coupled formwork panels according to the invention. "Coupled" means "adjoining each other horizontally at the respective coupling location" and/or "adjoining each other vertically at the respective coupling location". It is possible to use coupling elements for coupling which cooperate with the wall openings of the formwork panels mentioned hereinbefore. The coupling elements each may have a configuration that is similar to a door handle having a shaft portion integrally formed thereon. On the shaft portion, there may be provided two flanges. The coupling elements may be designed such that they can be brought into coupling engagement or out of coupling engagement by pivotal movement about the central axis of the shaft portion. The coupling elements may have one or more specific features described by way of FIGS. 33 to 35. Alongside the zone where two adjacent formwork panels are in contact with each other, a coupling element or several coupling elements can be used.

It is stressed that the coupling element disclosed in the present application, separately from the formwork panel according to the invention, constitutes a patentable subject matter of its own.

Advantageous materials for the coupling element are metal and plastics material.

In the wall shuttering according to the invention, there may be provided posts at the corners of the wall to be manufactured, with which formwork panels are coupled "across corner". This holds both for the inside and for the outside of the wall corner or column corner to be manufactured. In particular, the respective post may have a rectangular (longer than wide) or square horizontal cross-sectional area.

A further subject matter of the invention is a concrete-work ceiling shuttering in which several formwork panels according to the invention for creating a larger ceiling shuttering surface are supported in spatial proximity on a support structure (which may also be a support structure of conventional design). The support structure may be designed such that the respective formwork panels are each supported on at least one ceiling shuttering prop and/or at least one formwork panel beam, which formwork panel beam in turn is supported on ceiling shuttering props and/or main ceiling shuttering beams, which main ceiling shuttering beams in turn are supported on ceiling shuttering props.

A further subject matter of the invention is a method of making a formwork panel for concrete-work shutterings, as disclosed in the present application, characterized in that the supporting structure is injection-molded or compression-molded from a plastics material, preferably a fiber-reinforced plastics material;

that a formwork skin element or several formwork skin elements is/are injection-molded or compression-molded from plastics material that preferably is different from the plastics material of the supporting structure;

and that (a) in the event that the formwork skin is constituted by a single formwork skin element, this formwork skin element is releasably attached to the supporting structure, or (b) in the event that the formwork skin is constituted by several formwork skin elements, these several formwork skin elements are releasably attached to the supporting structure.

It is advantageous in this method when the single formwork skin element on the rear side thereof or the several formwork skin elements on the rear sides thereof each have a plurality of molded-on extensions, with screws being threadedly engaged at least with a partial number of the extensions from the rear side of the supporting structure. The screws may be self-tapping screws.

BRIEF DESCRIPTION OF THE DRAWINGS

The invention and more specific implementation options of the invention will be explained in more detail hereinafter by way of embodiments illustrated in the drawings, wherein:

FIG. 1 shows a perspective view of a formwork panel, looking obliquely onto the formwork panel front side facing the viewer;

FIG. 2 shows a perspective view of the formwork panel of FIG. 1, looking obliquely onto the formwork panel rear side facing the viewer;

FIG. 3 shows a perspective view of a supporting structure of the formwork panel of FIG. 1, looking obliquely onto the supporting structure front side facing the viewer;

FIG. 4 shows a perspective view of the supporting structure of FIG. 3, looking obliquely onto the supporting structure rear side facing the viewer;

FIG. 5 shows a perspective view of a formwork skin of the formwork panel of FIG. 1, looking obliquely onto the formwork skin front side facing the viewer;

FIG. 6 shows a perspective view of the formwork skin of FIG. 5, looking obliquely onto the rear side of the formwork skin of the formwork panel facing the viewer;

FIG. 7 shows a partial sectional view of the formwork panel of FIG. 1 along the line VII-VII in FIG. 4;

FIG. 8 shows a partial plan view of the rear side of the formwork panel of FIG. 1;

FIG. 9 shows a perspective view of a formwork panel, looking obliquely onto the formwork panel front side facing the viewer;

FIG. 10 shows a perspective view of the formwork panel of FIG. 9, looking obliquely onto the formwork panel rear side facing the viewer;

FIG. 11 shows a perspective view of a formwork skin of the formwork panel of FIG. 9, looking obliquely onto the formwork skin rear side facing the viewer;

FIG. 12 shows a partial view of the illustration of FIG. 11 in an enlarged scale;

FIG. 13 shows a partly sectional perspective view of part of the formwork panel of FIG. 9, looking obliquely onto the formwork panel rear side facing the viewer, in an intermediate phase of assembly of supporting structure and formwork skin;

FIG. 14 shows a partly sectional view as in FIG. 13, however after completion of the assembly operation;

FIG. 15 shows a perspective view of the formwork skin of the formwork panel, looking obliquely onto the formwork skin rear side facing the viewer;

FIG. 16 shows a partial view of the illustration of FIG. 15 in an enlarged scale;

FIG. 17 shows a partly sectional perspective view of part of the formwork panel, looking obliquely onto the formwork panel rear side facing the viewer, in an intermediate phase of assembly of supporting structure and formwork skin;

FIG. 18 shows a partly sectional view as in FIG. 17, however, upon completion of the assembly operation;

FIG. 19 shows a perspective view of a formwork panel, looking obliquely onto the formwork panel front side facing the viewer;

FIG. 20 shows a perspective view of the formwork panel of FIG. 19, looking obliquely onto the formwork panel rear side facing the viewer;

FIG. 21 shows a perspective view of the formwork skin of the formwork panel of FIG. 19, looking obliquely onto the formwork skin rear side facing the viewer;

FIG. 22 shows a partly sectional (section line XXII-XXII in FIG. 21) perspective view of part of the formwork panel of FIG. 19, looking obliquely onto the formwork panel rear side facing the viewer, in an intermediate phase of assembly of supporting structure and formwork skin;

FIG. 23 shows a partial sectional view as in FIG. 22, however, upon completion of the assembly operation;

FIG. 24 shows a perspective view of the formwork skin of the formwork panel, looking obliquely onto the formwork skin rear side facing the viewer;

FIG. 25 shows a partial view of the illustration of FIG. 24 in an enlarged scale;

FIG. 26 shows a partly sectional perspective view of part of the formwork panel, looking obliquely onto the formwork panel rear side facing the viewer;

FIG. 27 shows a partial sectional view of the formwork panel along XXVII-XXVII in FIG. 24;

FIG. 28 shows a partial plan view of the rear side of the formwork panel;

FIG. 36 shows a schematic plan view of the rear side of the formwork panel and the supporting structure of the same;

FIG. 37 shows a schematic sectional side view of the formwork panel of FIG. 36 along section line XXXVII-XXXVII in FIG. 36;

FIG. 38 shows a schematic sectional side view of the formwork panel of FIG. 36 along section line XXXVII-XXXVII in FIG. 36, however with a modification;

DETAILED DESCRIPTION OF THE INVENTION

In the following description of embodiments of the invention, the term "formwork panel" will be used instead of "formwork panel for concrete-work shutterings" for the sake of brevity. All formwork panels illustrated and described, in terms of the dimensioning and load bearing capacity of the same, are designed to withstand the loads arising during use in concrete-work shutterings.

The formwork panel 2 illustrated in FIGS. 1 to 8 is composed of two constituent parts, namely a supporting structure 4 and a formwork skin 6 which in the instant case is constituted by a single formwork skin element 8. Both the supporting structure 4 and the formwork skin element 8 in the instant case consist wholly of plastics material.

Figure 1:
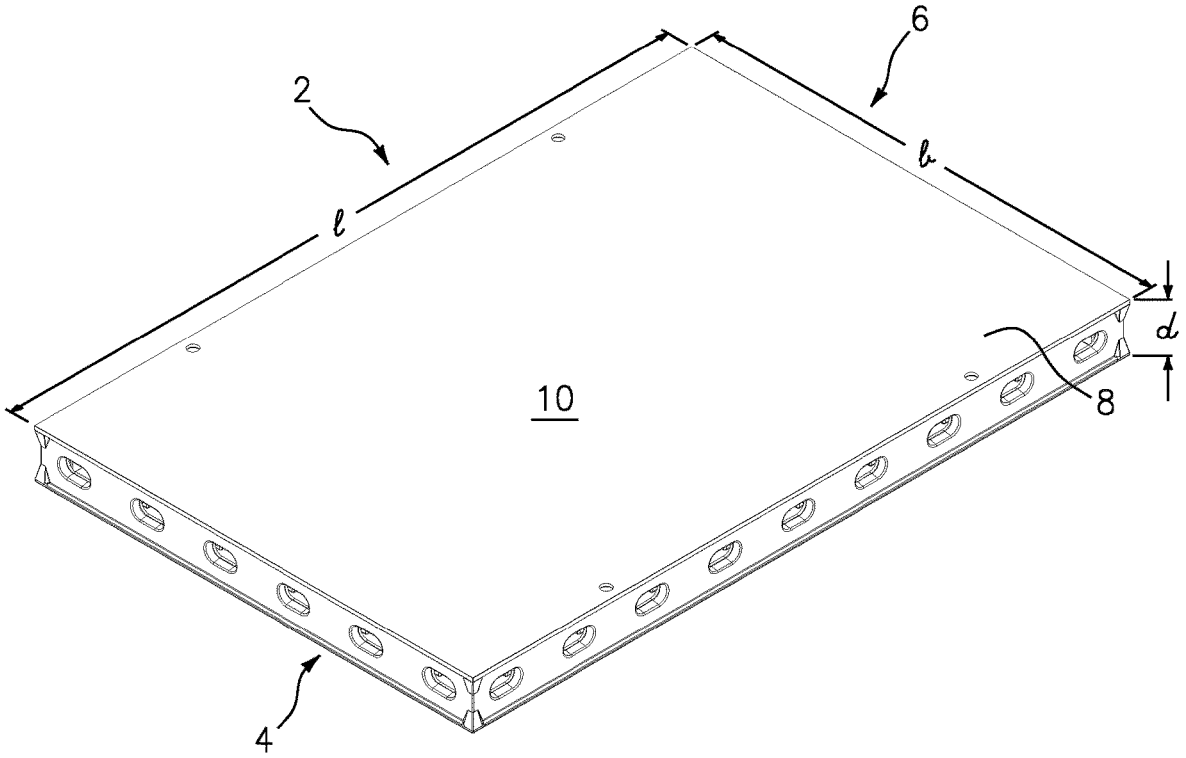
FIGS. 1 to 8 show a first embodiment of a formwork panel for concrete-work shutterings according to the invention, wherein in detail.
Figure 2:
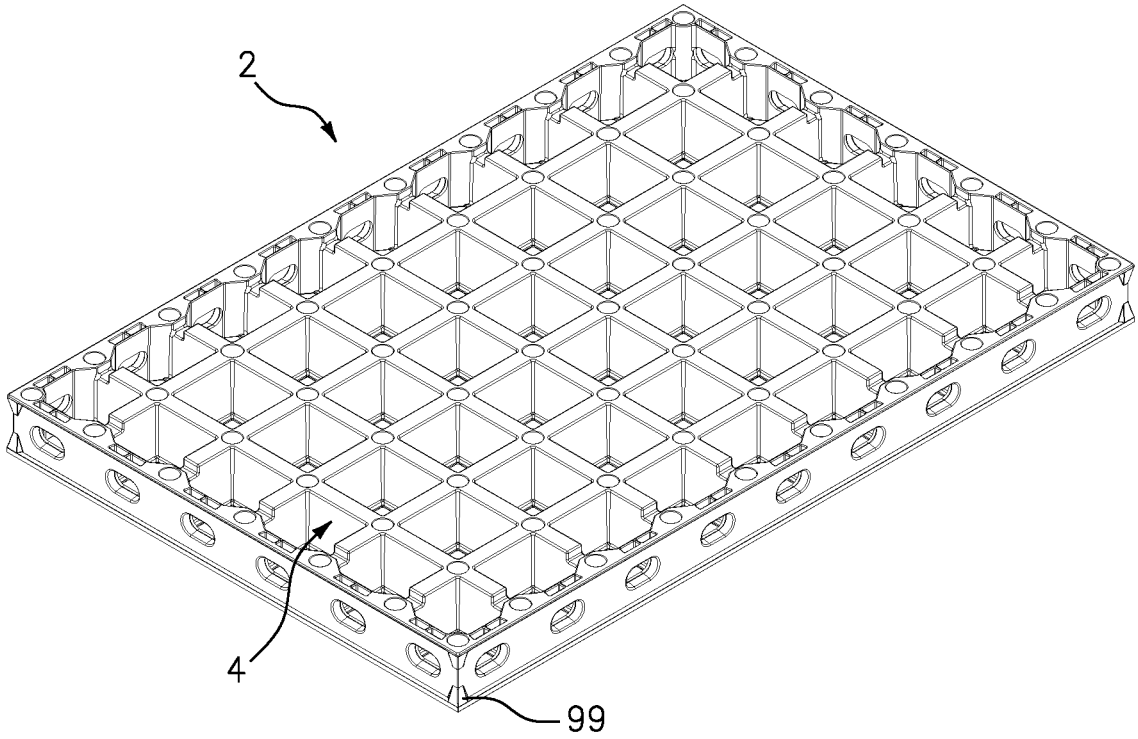

Seen in total, the formwork panel has the shape or geometry of a right parallelepiped which—as measured at right angles to the plane of the formwork skin front side 10 visible in FIG. 1 and being at the same time the formwork panel front side 10—has a considerably smaller dimension or thickness d than its longitudinal dimension l and its width dimension b. In the embodiment illustrated, the length l e.g. is 135 cm, the width b is 90 cm and the thickness d is 10 cm.

Figure 3:
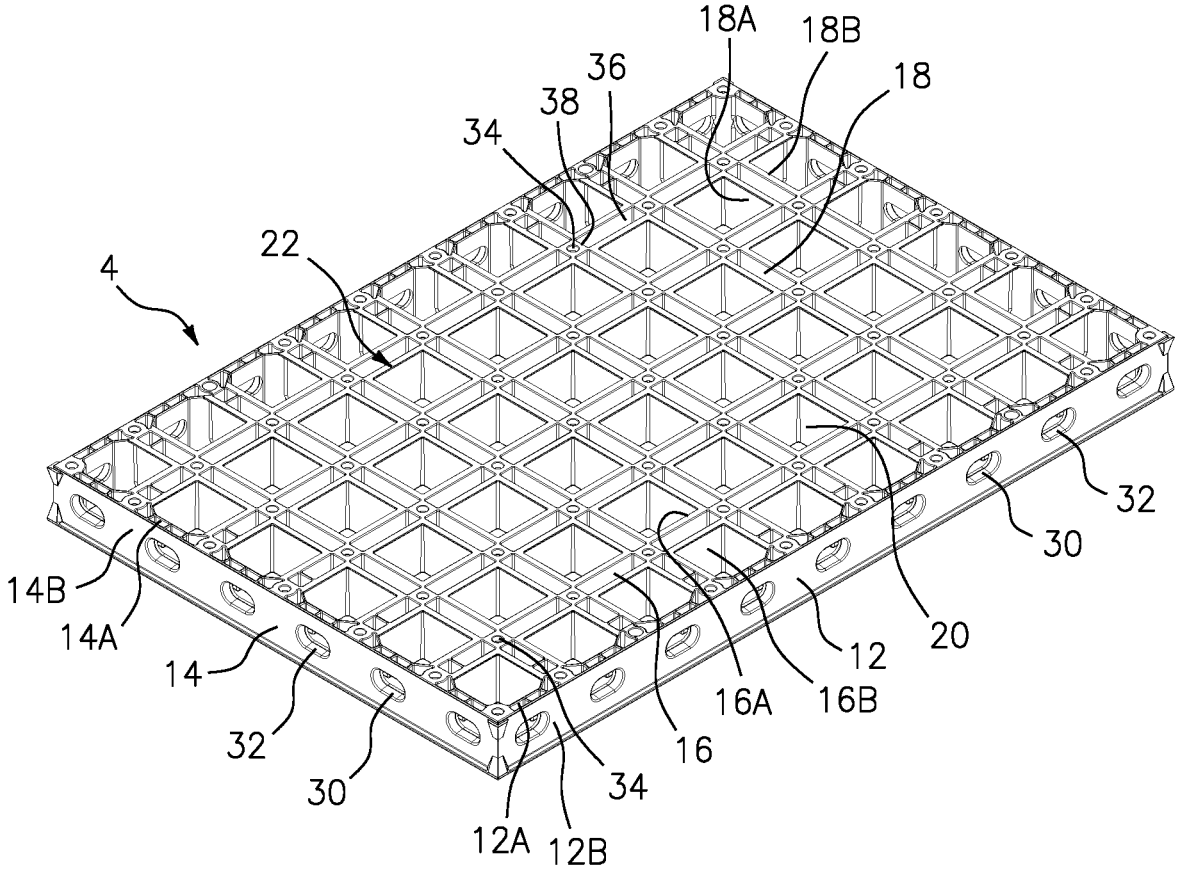
Figure 4:
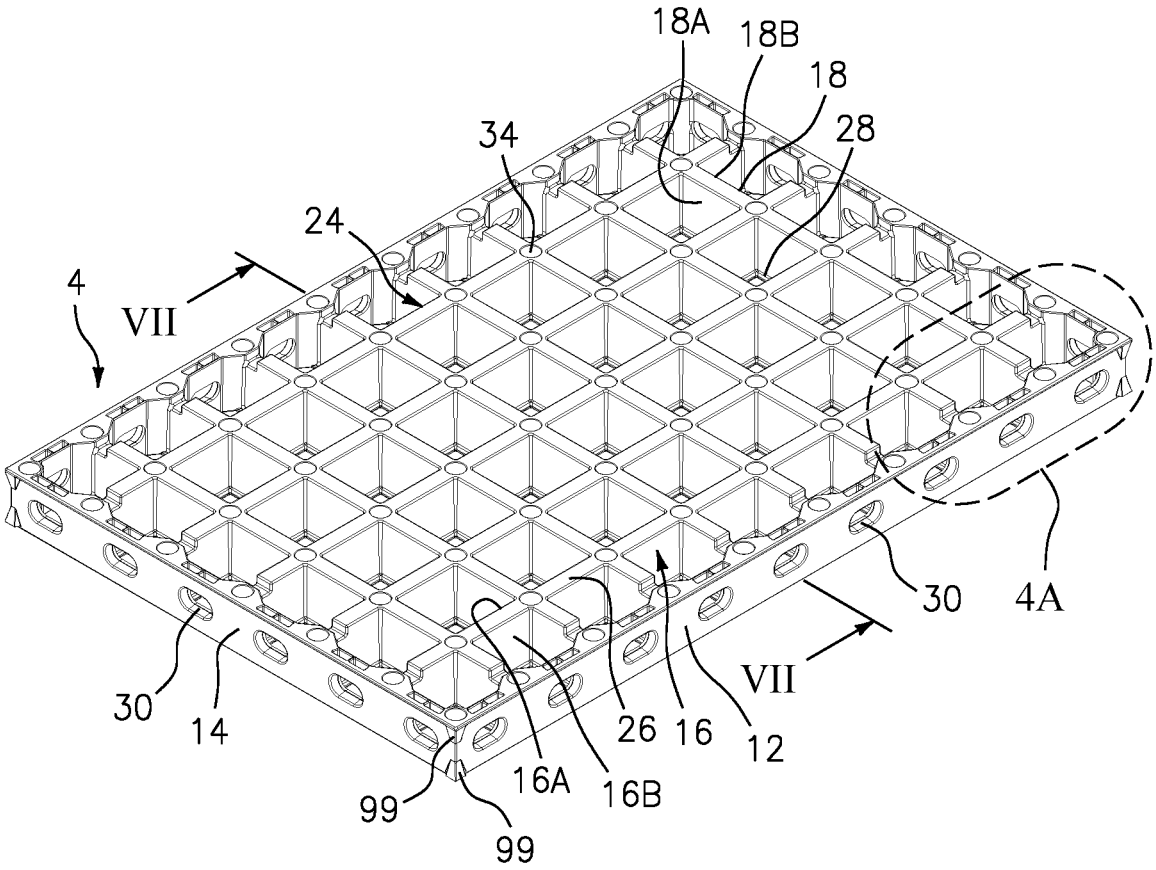

FIGS. 3 and 4 reveal particularly clearly that the supporting structure 4 has the configuration of a grating. Each of the two longitudinal edges is in the form of a double-walled wall 12 (each wall 12 having wall portions 12A and 12B), and each of the two transverse edges is in the form of a double-walled wall 14 (each wall 14 having wall portions 14A and 14B). Between the longitudinal peripheral walls 12 and parallel to the same, there are—in the embodiment illustrated five—longitudinal intermediate walls 16 (each wall 16 having wall portions 16A and 16B) of double-walled design. Between the transverse peripheral walls 14 and parallel to the same, there are—in the embodiment illustrated eight—transverse intermediate walls 18 (each wall 18 having wall portions 18A and 18B) of double-walled design each. The clear distances between the longitudinal intermediate walls 16 as well as between the respective "last" longitudinal intermediate wall 16 and the respective longitudinal peripheral wall 12 are all mutually alike. The clear distances between the transverse intermediate walls 18 as well as between the respective "last" transverse intermediate wall 14 and the respective transverse peripheral wall 14 are all mutually alike, and moreover, identical with the distance between the various longitudinal walls 12, 16 as described hereinbefore. Between the various walls 12, 14, 16, 18, there is thus formed a matrix-like or chessboard-like arrangement of—as seen in a plan view of the front side (FIG. 3) or the rear side (FIG. 4)—substantially square openings 20 each, which are open both towards the front side 22 of the supporting structure 4 and towards the rear side 24 of the supporting structure 4, however in a somewhat different size, as will be described in more detail further below. In the embodiment illustrated, there are provided nine openings 20 in series in the longitudinal direction l of the supporting structure 4 and six openings 20 in series in the transverse direction b. In the embodiment illustrated, each clear opening 20—as measured at the front side 22—has a size of approx. 10×10 cm.

Figure 7:
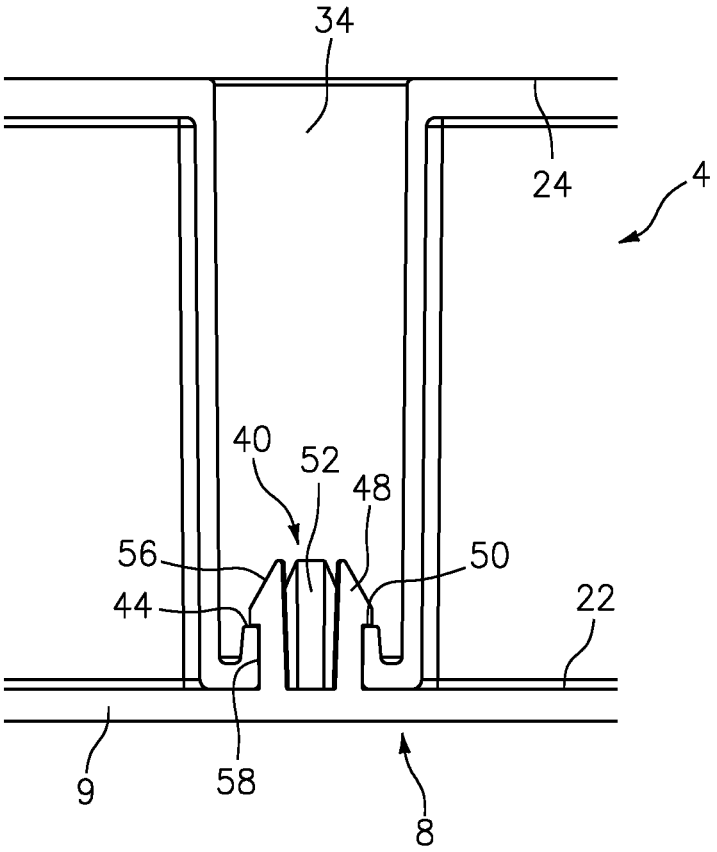
Figure 8:
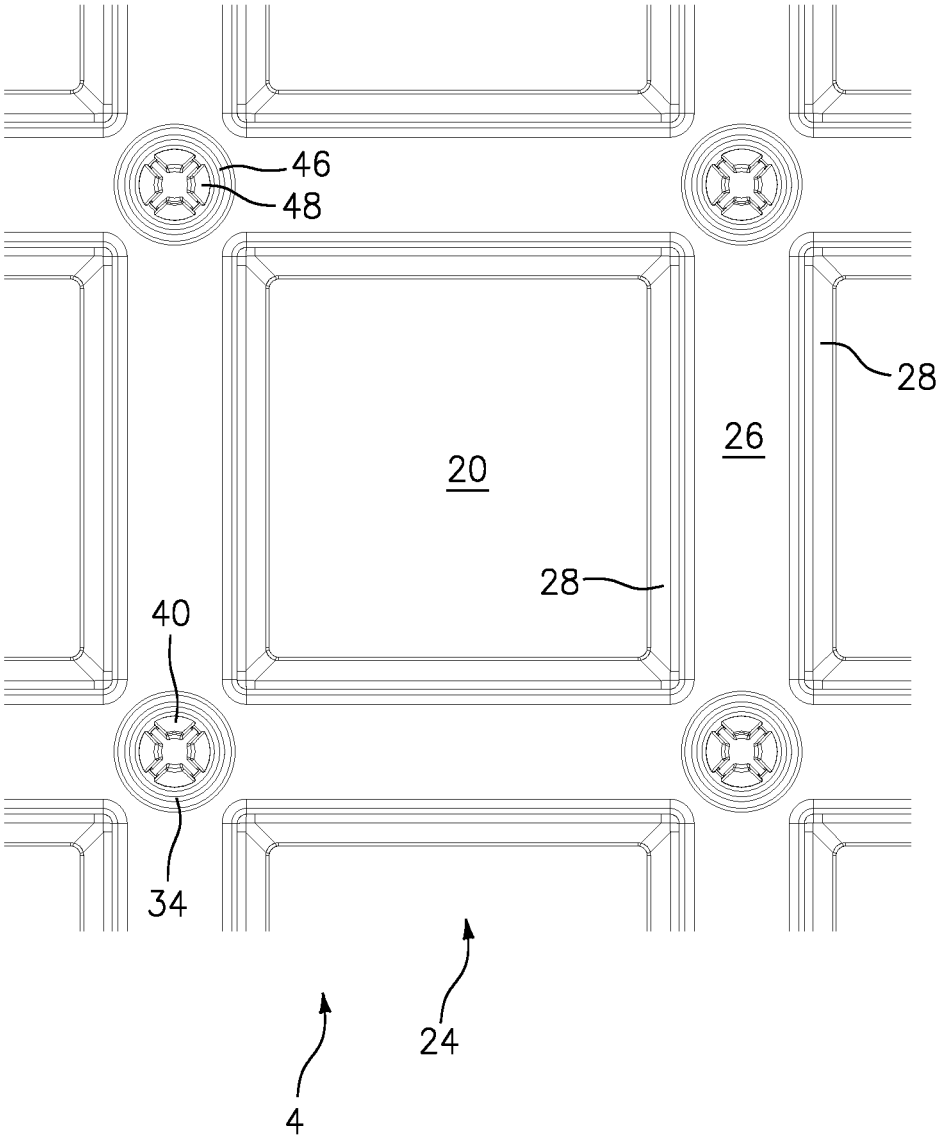
Figure 9:
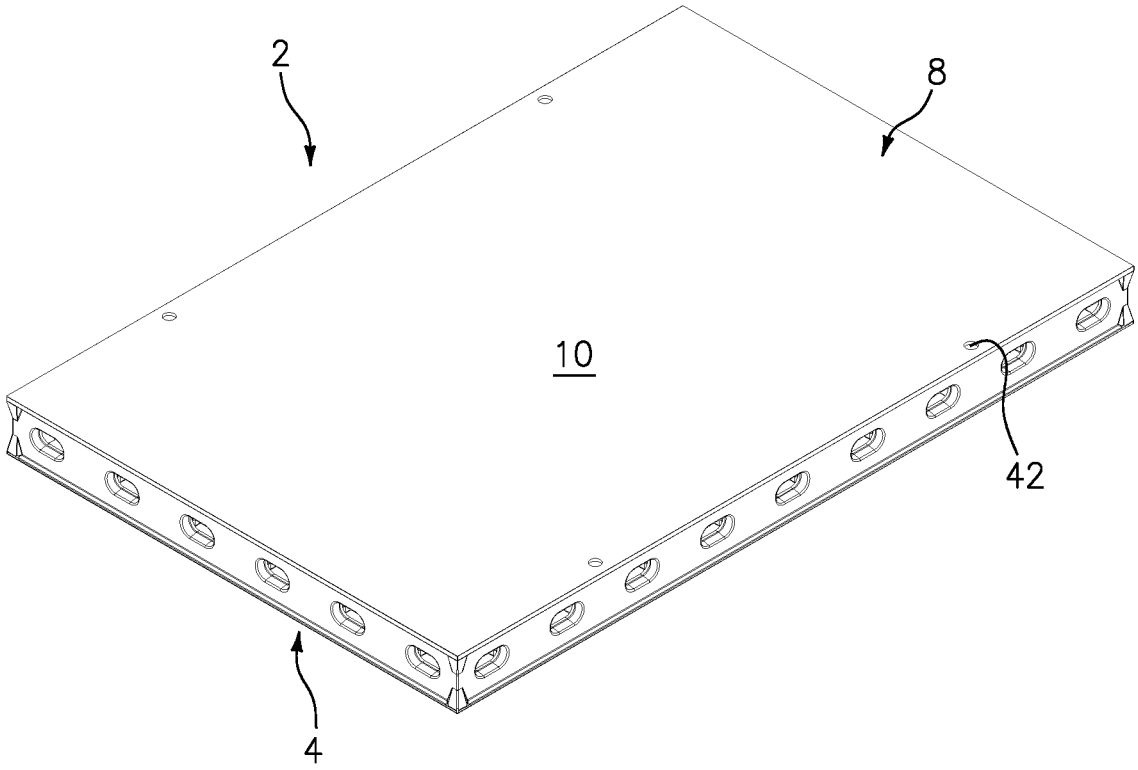
FIGS. 9 to 14 show a second embodiment of a formwork panel for concrete-work shutterings according to the invention, wherein in detail.
Figure 10:
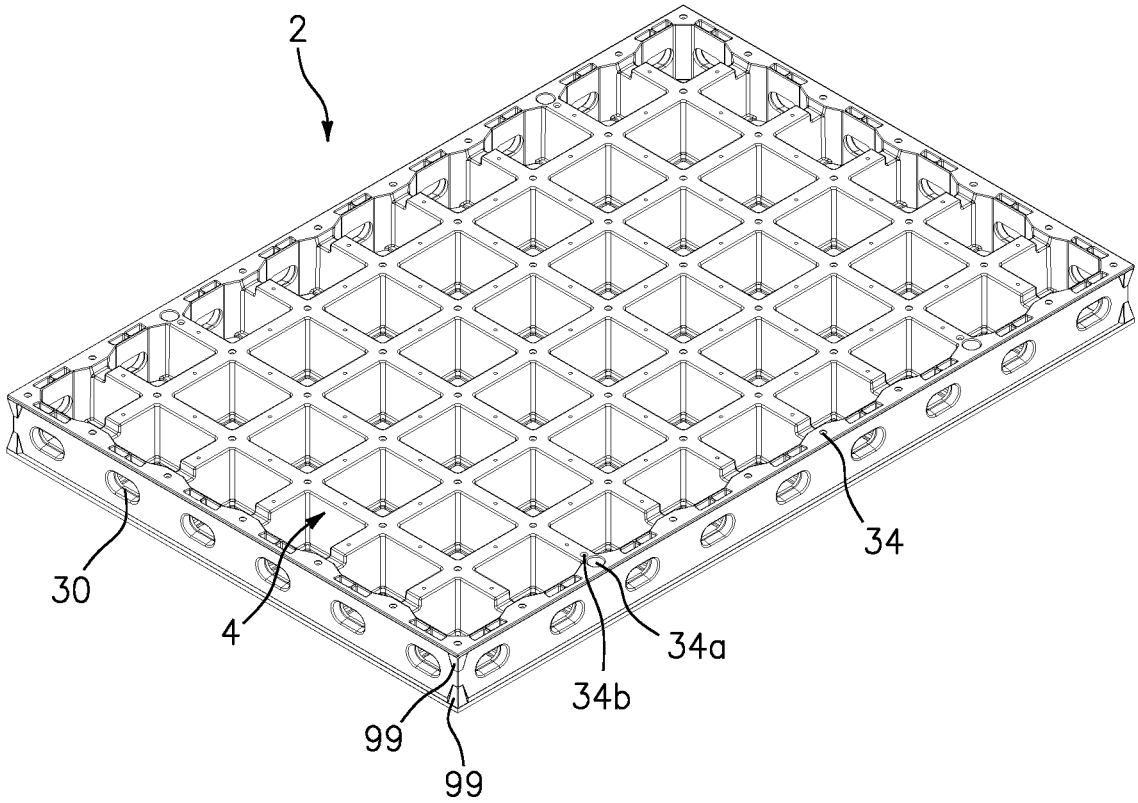
Figure 11:
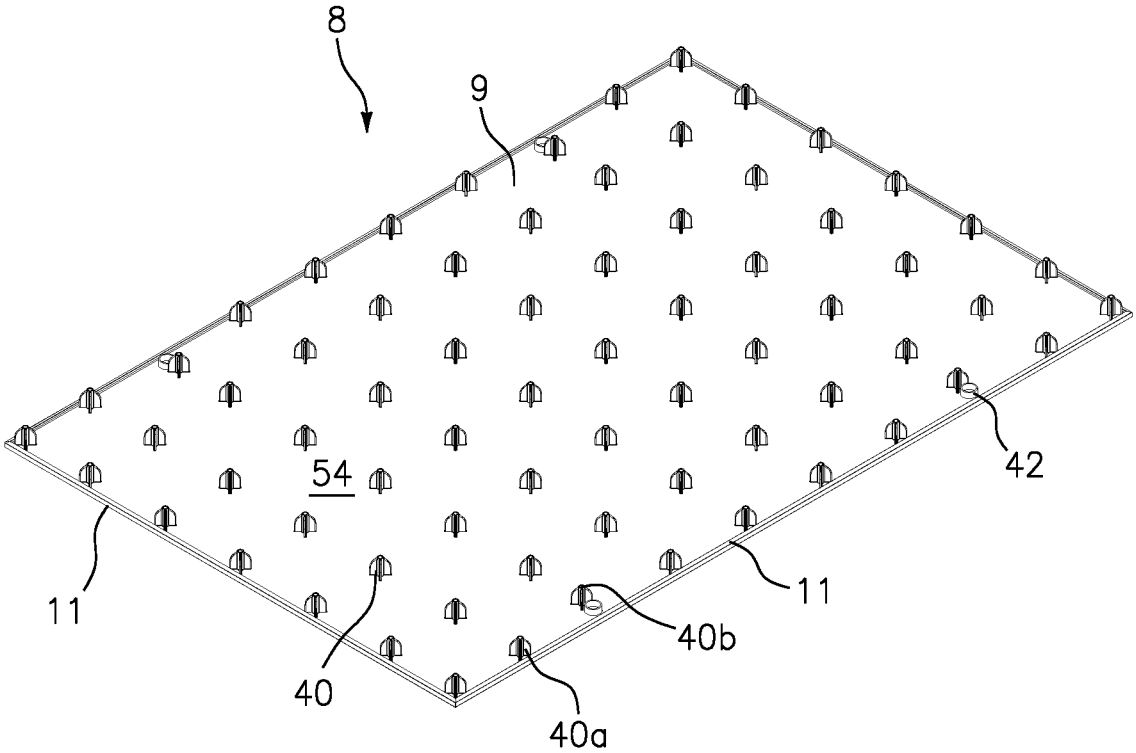
Figure 12:
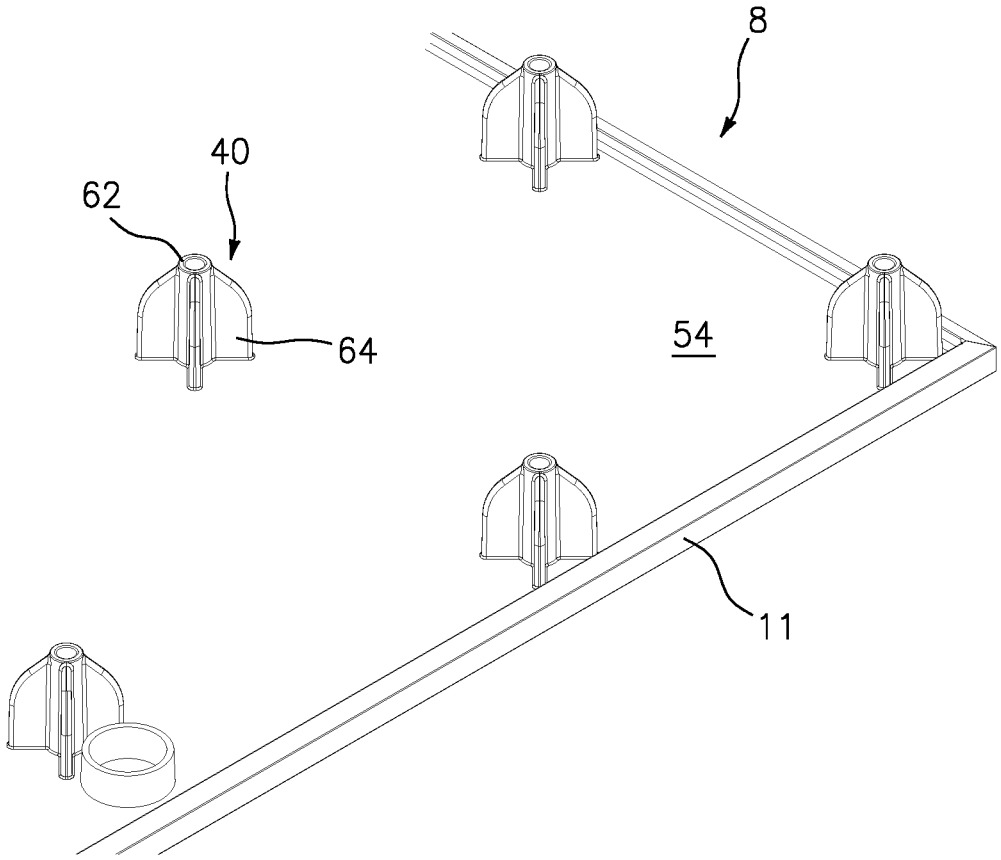

Looking at the rear side 24 of the supporting structure 4 (FIG. 4), it can be seen that the double-wall structure of the intermediate walls 16, 18 at the rear end is "closed" by a material portion 26 each extending parallel to the formwork skin front side 10 (e.g., a respective material portion 26 extends between the wall portions 16A and 16B of intermediate wall 16 to close the double-wall structure of the respective intermediate wall 16, and/or a respective material portion 26 extends between the wall portions 18A and 18B of intermediate wall 18 to close the double-wall structure of the respective intermediate wall 18); this brings additional material to the rear side 24 of the supporting structure. FIG. 8 reveals that the intermediate walls 16, 18, in their end portion adjacent the front side 22, each have on both sides thereof a flange 28 which so to speak widens the intermediate wall 16 and 18, respectively. Looking at the respective intermediate wall 16 or 18 in a cross-section, this can be referred to as hat-shaped double wall cross-sectional area (cf. in this regard also FIGS. 29 and 30; although shown in a different embodiment, but equally present in so far also in the embodiment of FIGS. 1 to 8). The flanges 28 bring additional plastics material near the front side 22; moreover, the abutment or resting surface for the formwork skin 6 is enlarged and the clear distances between the supports for the formwork skin element 8 are reduced. Thus, the clear cross-section at the front side 22 of the openings 20 is smaller than at the rear side 24, where it has a size of approx. 12×12 cm.

The longitudinal peripheral walls 12 and the transverse peripheral 14, at the locations thereof where an opening 20 is provided inwardly of the longitudinal wall 12 or 14, each have an oval wall opening 30 in the form of an elongated hole traversing the respective peripheral wall 12 and 14, respectively. Each oval wall opening 30 being defined by a length 30A and a width 30B, wherein the width 30B is perpendicular to the length 30A and the length 30A is greater than the width 30B. The length 30A of each oval wall opening 30 extends in a lengthwise direction of the respective peripheral wall 12, 14. Each opening 30 may be described as having a first lengthwise end 30C, a second lengthwise end 30D, and a central section 30E disposed between the lengthwise ends 30C, 30D. At least a portion of the width 30B is constant within the central section 30E. The openings 30 each penetrate the peripheral walls 12 and 14 completely (i.e. they extend through both wall portions of the respective double-wall structure) and are surrounded by an opening circumferential wall 32. Moreover, it is pointed out here that in the peripheral walls 12 and 14, the respective outer surface (i.e. the surface facing away from the center of the supporting structure 4) is slightly recessed from the outer contour of the supporting structure 4. In other words, the outer contour on the rear side 24 constitutes a slightly larger rectangle than the rectangle line along the aforementioned outer surfaces of the peripheral walls 12 and 14.

At the locations where respective intermediate walls 16 and 18 cross, as well as at the locations where the intermediate walls 16 and 18 merge into the peripheral walls 12 and 14, respectively, there is provided a channel 34 of round cross-section each, which is delimited with respect to the adjacent three or four interstices 36 formed by the double-wall structure by walls 38. The channels 34 are each continuous from the front side 22 to the rear side 24.

Figure 5:
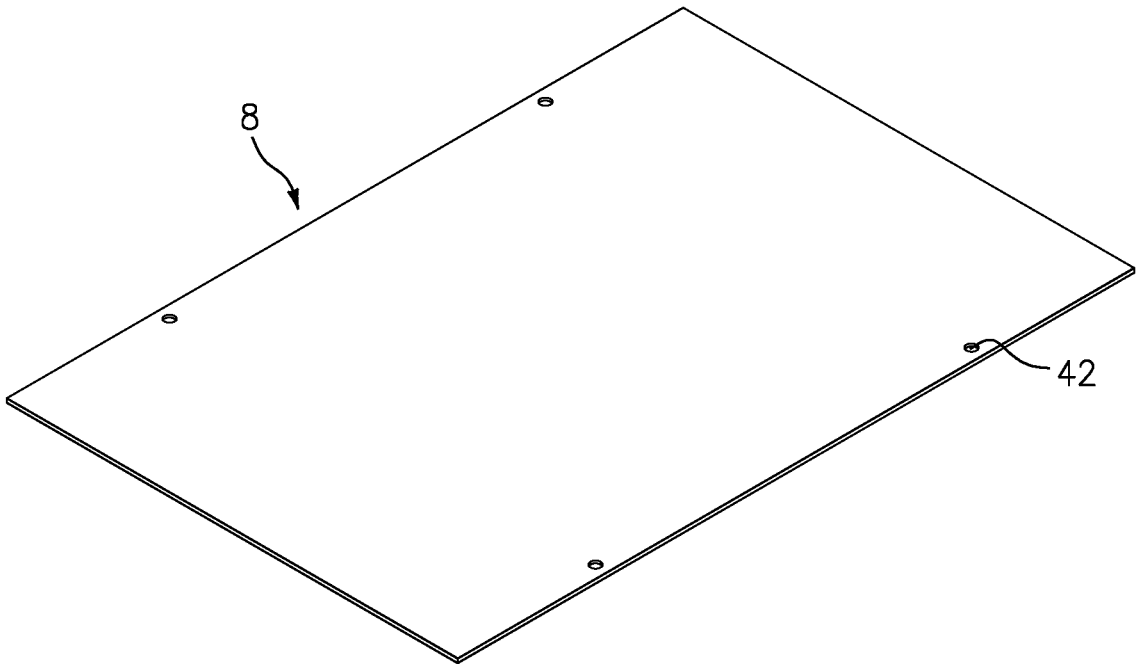
Figure 6:
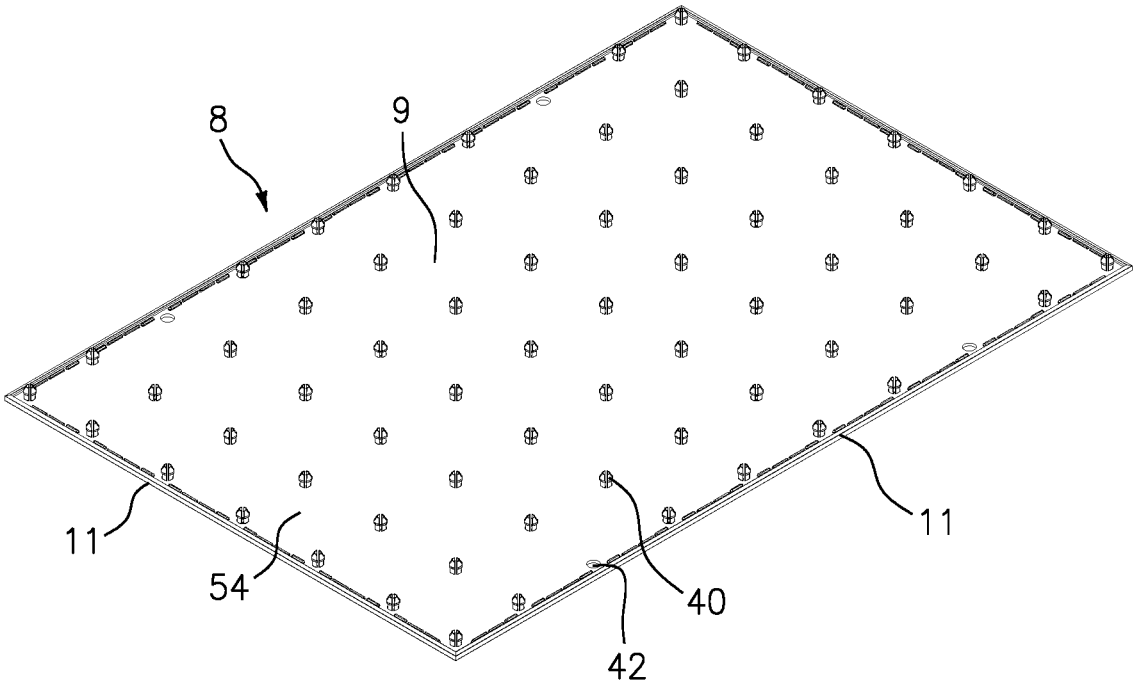

FIGS. 5 and 6 show that the formwork skin element 8 has the shape of a plate with extensions 40 on the rear side. The function of the four round openings 42 visible in FIG. 5, which are located near the longitudinal edges of the formwork skin element 8, will still be discussed in more detail further below.

In the embodiment illustrated, there is a total of 66 (i.e. 70 minus four openings 42) extensions 40. The extensions 40 are each provided at a crossing location between intermediate walls 16 and 18 and, respectively, at a T-location between a peripheral wall 12 and 14 and an intermediate wall 16 and 18, respectively, with the exception of the locations of the four openings 42. The extensions 40 thus are arranged in the pattern of a matrix or a chessboard pattern.

When the supporting structure 4 and the formwork skin element 8 are joined together, each respective extension 40 enters into the front-side end portion of a channel 34. FIG. 7 shows that each channel 34, in its end portion adjacent the front side 22 of the supporting structure 4, has a reduced, round cross-section so that a shoulder 44 is formed in the direction towards the rear side 24 of the supporting structure 4. Furthermore, it can be seen from FIGS. 7 and 8 that each extension 40 is subdivided by corresponding longitudinally extending slits 46 into four tongues 48 distributed about the circumference of the extension. Each of the tongues 48, in the central portion of its length, has on its outside a respective shoulder 50 which extends across part of a circle for slightly less than 90° and, in the assembled state of supporting structure 4 and formwork skin element 8, is latched outwardly behind the respective shoulder 44 of channel 34 or of supporting structure 4. In the center, i.e. inwardly between the four tongues 48, each of the extensions 40 has an axially extending cavity 52 which terminates approximately at the level of the plate rear side 54 of the formwork skin element 8. Moreover, each of the tongues 48, in the end portion thereof facing the rear side 24 of the supporting structure 4, is tapered at the outside thereof, as shown at numeral 56. In the light of the design described of the respective extension 40, the extensions 40, for assembly of supporting structure 4 and formwork skin element 8, can each be introduced into the portion of smaller cross-section of a channel 34. Due to the tapered surfaces 56, the tongues 48 during such introduction are slightly resiliently compressed towards the extension central axis, and the respective extension 40 enters increasingly deeply into the respective channel 34 until—due to the tongues 48 elastically resiling towards the outside—the shoulders 50 of the respective extension 14 snap behind the shoulder 44 of the respective channel 34.

By way of the engagement described of each extension 40 with the shoulder 44 of a channel 34, there is created a connection or attachment between the supporting structure 4 and the formwork skin element 8 which holds the supporting structure 4 and the formwork skin element 8 together against the action of tensile forces acting in the longitudinal direction of the channels 34 or—in other words—perpendicularly to the formwork panel front side 10. As in each extension 40 the tongues 48 at the circumference are in contact with that part of the respective channel 34 where the latter has a smaller cross-section (cf. numeral 58), and as the tongues 48 have a sufficiently large material cross-sectional area there, the female-male engagement between this portion of the respective extension 40 and the portion of smaller cross-section 58 of the respective channel 34 creates a connection that is capable of transferring shear forces with respect to the interface between the front side 22 of the supporting structure 4 and the plate rear side 54 of the formwork skin element 8 (i.e. with respect to forces acting parallel to the formwork panel front side 10). The supporting structure 4 and the formwork skin element 8 thus constitute an at least largely commonly supporting structure with respect to the forces arising.

It was already mentioned hereinbefore that the formwork skin element 8 has a circular opening 42 each at two locations near the one longitudinal edge and at two locations near the other longitudinal edge. Each of the openings 42 is provided at a location where a channel 34 is positioned in the supporting structure 4. There are thus formed four locations at which a respective so-called tie anchor (in the central portion of interest here of the tie anchor, this is in essence a rod) can be slidingly inserted through the complete formwork panel 2, i.e. supporting structure 4 and formwork skin element 8, as well as completely through a formwork panel 2 set up parallel thereto in spaced apart manner. Such tie anchors are used in particular in concrete-work wall shutterings where formwork panels are set up in spaced apart manner in order to create a concrete wall by pouring concrete into the space between the panels. On the rear sides 24 of the formwork panels 2 of the respective formwork panel pair, which are directed away from the space between such panels, e.g. nut plates are threadedly engaged with the tie anchors. The tie anchors take up those forces which the poured, pulpy concrete exerts in the sense of urging the formwork panels of the formwork panel pair apart.

The attachment of the formwork skin element 8 to the supporting structure 4 is releasable. It is merely necessary to radially compress the respective tongues 48 of the extensions in order to be then able to remove the formwork skin element 8 from the supporting structure 4. An alternative possibility consists in performing a rotational movement of the formwork skin element 8 in relation to the supporting structure 4, which causes destruction of the attachment.

FIG. 6 (but still more clearly FIGS. 11, 12, 15, 16 below) shows that the plate-like portion 9 of the formwork skin element 8, i.e. the formwork skin element 8 without the extensions 40, on all four edges on the rear side thereof has a marginal strip 11 which is thicker in the direction of the formwork skin element thickness d and which at that location increases the load bearing capacity and the wear resistance of the formwork skin element 8 as well as the tightness of the formwork panel 2 with respect to adjacent formwork panels 2. When the application refers to the plate rear side 54 of the formwork skin element, the rear side inside the marginal strips 11 is meant. Inside of the marginal strips 11, the "plate thickness" of the plastics material in the present embodiment is 5 mm.

By way of FIGS. 9 to 14, a second embodiment of a formwork panel 2 according to the invention will be described in the following. The modifications in comparison with the first embodiment according to FIGS. 1 to 8 in essence concern merely the design of the means provided for connecting or attaching the supporting structure 4 and the formwork skin element 8 to each other. The following description concentrates on these modifications.

Figure 13:
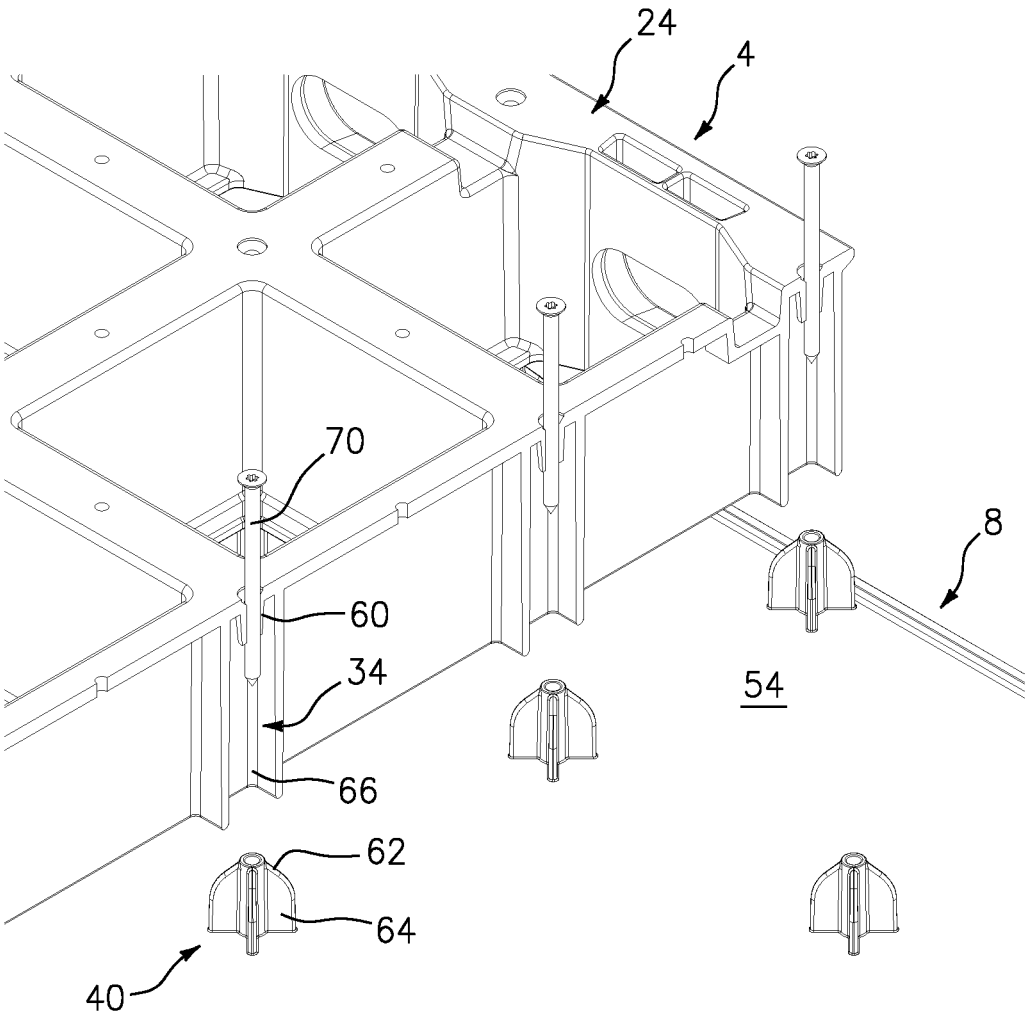
Figure 14:
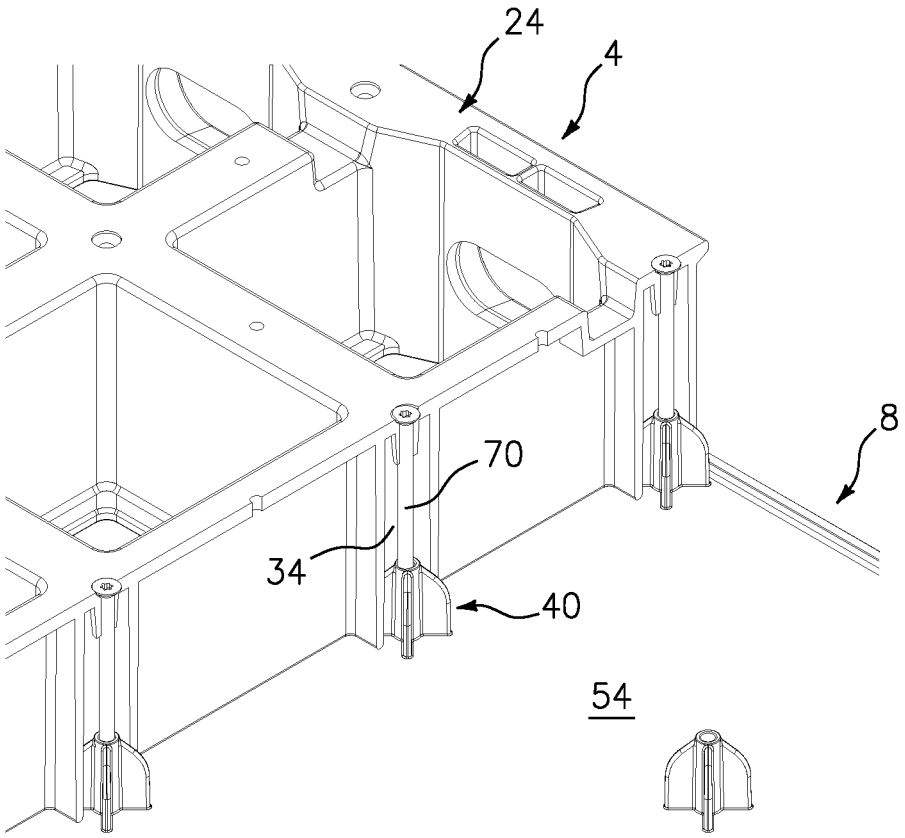
Figure 15:
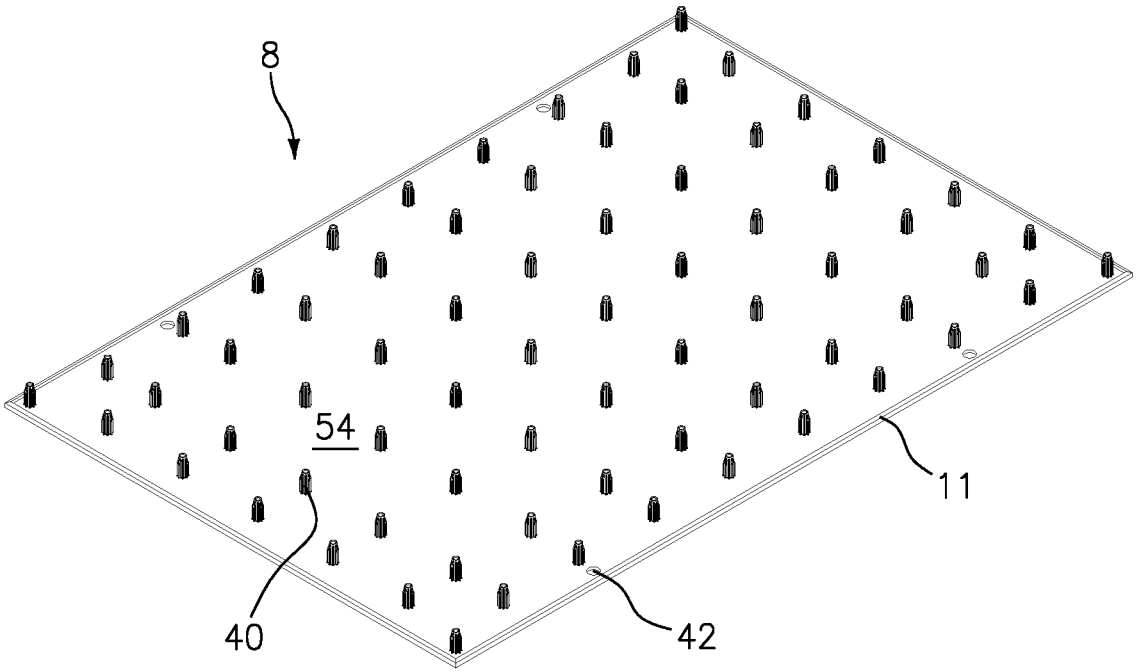
FIGS. 15 to 18 show a third embodiment of a formwork panel for concrete-work shutterings according to the invention, wherein in detail.
Figure 16:
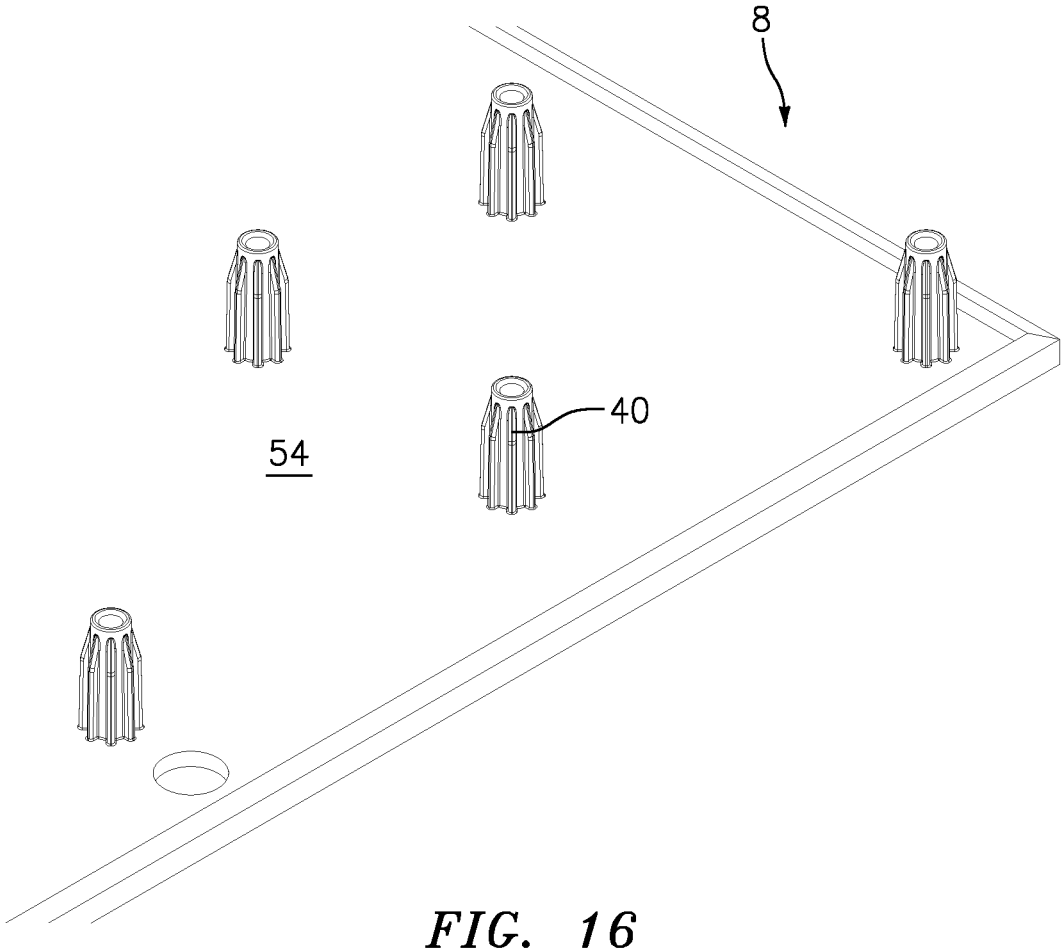
Figure 17:
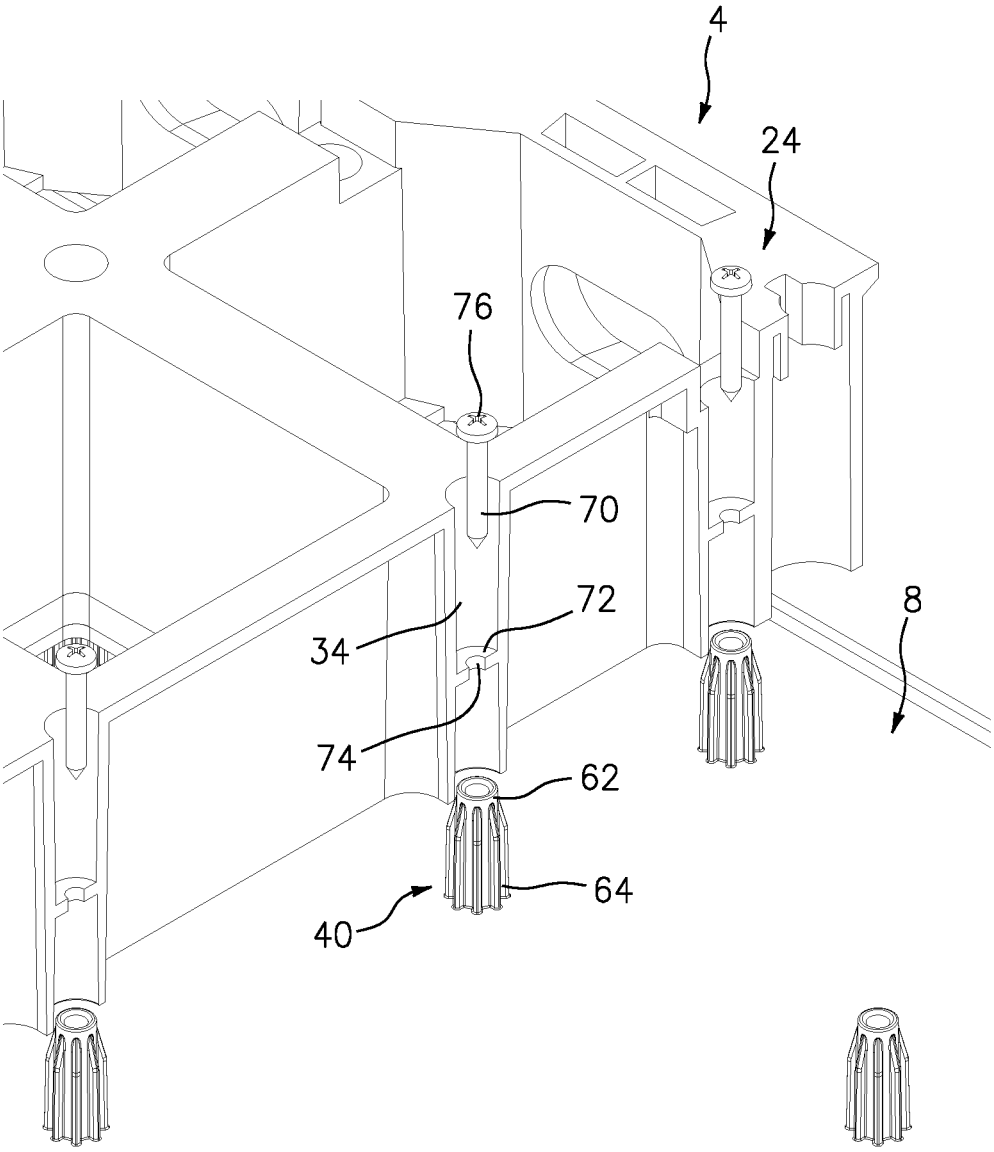

As is clearly visible in FIGS. 13 and 14, the channels 34 used for releasably connecting or attaching the supporting structure 4 and the formwork skin element 8 to each other have no reduced cross-section in the end portion adjacent the front side 22 of the supporting structure 4, but have a hollow socket 60 of round cross-section in the end portion adjacent the rear side 24 of the supporting structure 4, which both at the inner circumference and at the outer circumference is of smaller cross-section than the remainder of the channel 34.

The extensions 40 now each have a cross-section which can be described as hollow-cylindrical central socket 62 with four radially extending ribs 64 spaced apart by an angle of 90°. Each extension 40 projects from the plate rear side 54 of the formwork skin element 8 by a length corresponding approximately to one third of the thickness of the supporting structure 4. As seen in cross-section through the respective extension 40, the four ribs 64 are dimensioned such that the rib ends extend just as far as the four inner corners 66 of the respective channel 34. Thus, each of the molded-on extensions 40 and thus the entirety of all extensions 40 in cooperation with the respective channels 34 by means of female/male engagements, provides for an interconnection between supporting structure 4 and formwork skin element 8 which is capable of transferring shear forces acting parallel to the formwork panel front side 10.

For mutual anchoring of supporting structure 4 and formwork skin element 8, there are no longer provided latching tongues of the extensions 40, but screws 70 cooperating with the extensions 40 which, from the rear side 24 of the supporting structure 4 and through the sockets 60 of the supporting structure 4, are each threadedly engaged with the interior of the hollow socket 62 of the respective extension 14, cf. the final state illustrated in FIG. 14. The screws 70 are self-tapping and themselves cut their respective counterthread in the respective hollow socket 62 during assembly of supporting structure 4 and formwork skin element 8. By unfastening the screws 70, the interconnected state or mutual attachment state of supporting structure 4 and formwork skin element 8 can be easily released. The threaded connections between the screws 70 and the extensions 40 provide for an interconnection that is capable of transferring tensile forces acting perpendicularly to the formwork panel front side 10, in the sense of separating the supporting structure 4 and the formwork skin element 8.

The second embodiment tends to permit more efficient manufacture than the first embodiment and thus allows somewhat larger measurement tolerances between supporting structure 4 and formwork skin element 8. It is expressly pointed out that it is not necessary to install a screw 70 in each of the channels 34. It is sufficient for the strength of the connection when only part of the channels 34 has a screw 70 fastened therein. The extensions 40 may be formed with higher bending strength than in case of the first embodiment.

As in case of the first embodiment, there are also channels 34*a* and formwork skin element openings 42 for tie anchors. Near the openings 42, there is a respective extension 40*b* which—in comparison with an "ordinary extension" 40*a* at the longitudinal edge of the formwork skin element 8—is slightly displaced towards the longitudinal central line of the formwork skin element 8. For such extensions 40*b*, there are correspondingly slightly displaced channels 34*b* provided in the supporting structure 4.

A third embodiment of a formwork panel according to the invention will now be described by way of FIGS. 15 to 18. The third embodiment is similar to the second embodiment described hereinbefore. The following description concentrates on the differences from the second embodiment.

The channels 34 in the supporting structure 4 are of round cross-section and neither have a reduction in cross-section in the end portion adjacent the supporting structure front side 22, nor a reduction in cross-section in the end portion adjacent the supporting structure rear side 24. In the central portion of the length of the respective channel 34, however, there is provided a transverse wall 72 having a central hole 74. The transverse wall 72 serves as an abutment for the screw head 76 of a respective screw 70 inserted there from the supporting structure rear side 24 through said hole 74.

The formwork skin element extensions 40 in this embodiment have the shape of a central hollow connecting piece 62 having e.g. eight circumferentially distributed ribs 64 which are clearly shorter in radial direction than in the second embodiment. As in case of the second embodiment, a self-tapping screw 70 is threadedly inserted into an extension 14 at the locations deemed necessary.

In the following, a fourth embodiment of a formwork panel according to the invention will be described by way of FIGS. 19 to 23. The fourth embodiment differs from the preceding embodiments in essence by the type of connection or mutual attachment of supporting structure 4 and formwork skin element 8. The following description concentrates on the description of these differences.

Figure 22:
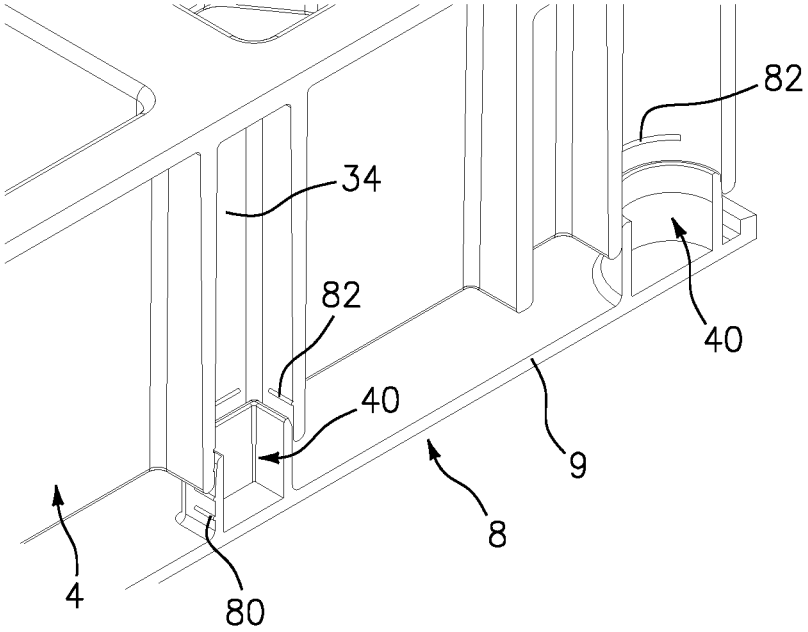
Figure 23:
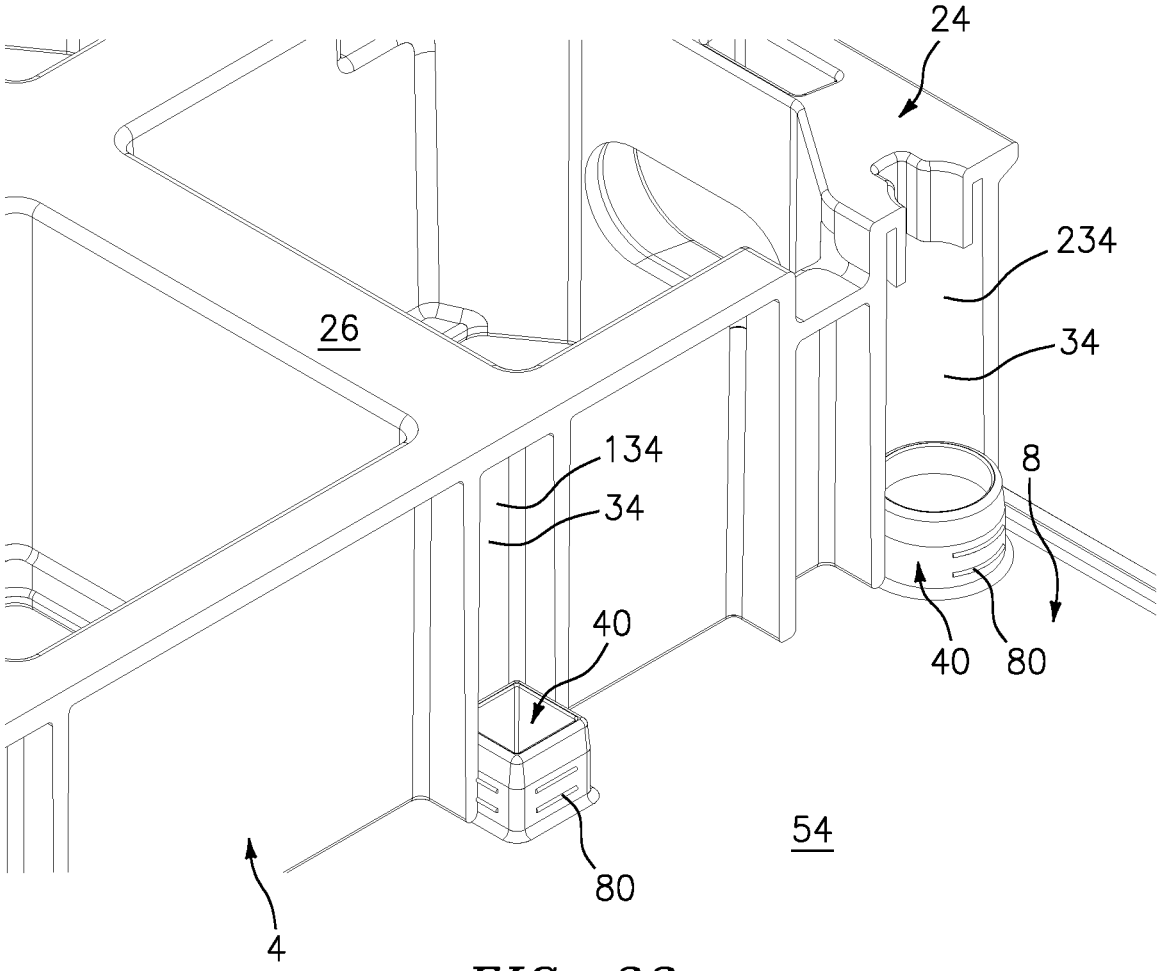

As can be seen fastest in FIGS. 22 and 23, there are provided circular, hollow, molded-on extensions 40 along the longitudinal edges and the transverse edges of the formwork skin element 8, whereas otherwise hollow, molded-on extensions 40 of square cross-section are provided. Each of the extensions 40 has, at the outer circumference thereof, a first interrupted series of circumferentially extending, projecting portions 80 on its outside which are arranged in a first plane. In a second plane which is axially spaced apart from the first plane, there is provided a second interrupted series of projecting portions 80 at the outer circumference. The number of these circumferential rows may alternatively be smaller or greater than two.

At the inner circumference of the respective associated channels 34 of the supporting structure 4, there are provided recessed portions 82, also in the form of circumferentially interrupted portions in two planes or also more planes or less planes. The projecting portions 80 and the recessed portions 82 are positioned such that, upon mating of supporting structure 4 and formwork skin element 8 with slight elastic deformation of extensions 40 and/or channel walls, the projecting portions 80 engage within the inwardly projecting counter-portions 82 and are fixed there until a considerable releasing force or withdrawal force is applied. Between each extension 40 and the respective associated channel 34, there is thus produced a female/male engagement.

Such slightly projecting portions 80 and such slightly inwardly projecting counter-portions 82 can be molded-on in the formation of the supporting structure 4 and the formwork skin element 8, in particular by plastics injection molding or by plastics compression molding, without this necessitating the use of slides in the manufacturing mold that are slidable in the direction transverse to the main extension plane of supporting structure 4 and formwork skin element 8, respectively. Rather, the manufacturing mold can simply have corresponding recesses at the locations where projecting portions 80 are to be formed. The formwork skin element produced, in particular while the molded product is still warm, can be ejected from the mold cavity under elastic deformation. In forming the supporting structure 4, on the other hand, the manufacturing mold has to be provided with corresponding bulges at the locations where the recessed portions 82 are to be formed. As regards the ejection from the manufacturing mold, the statements made in relation to the formwork skin element 8 apply analogously. As an alternative, the extensions 40 can be provided with recessed portions and the channels 34 with projecting portions.

In the embodiment illustrated, the extensions 40 take up approximately one fourth of the length of the channels 34.

In the fourth embodiment, the channels 34 can be closed at their end adjacent the supporting structure rear side 24 (cf. the channel 134 on the left side in FIG. 23), or can also be open (cf. the channel 234 on the right side in FIG. 23).

A hollow circular shape and a hollow square shape of the extensions 40 are expedient for practical application, but may also be replaced by other cross-sectional shapes. The drawings illustrate the situation of two different geometries of the extensions 40. It is also possible for all geometries to be identical, or there may be more than two different geometries realized.

By way of FIGS. 24 to 28, a fifth embodiment of a formwork panel 2 according to the invention will be described in the following. The fifth embodiment differs from the preceding embodiments in essence only by the type of connection or mutual attachment of supporting structure 4 and formwork skin element 8. The following description of the first embodiment concentrates on the description of the differences from the preceding embodiments.

Figure 24:
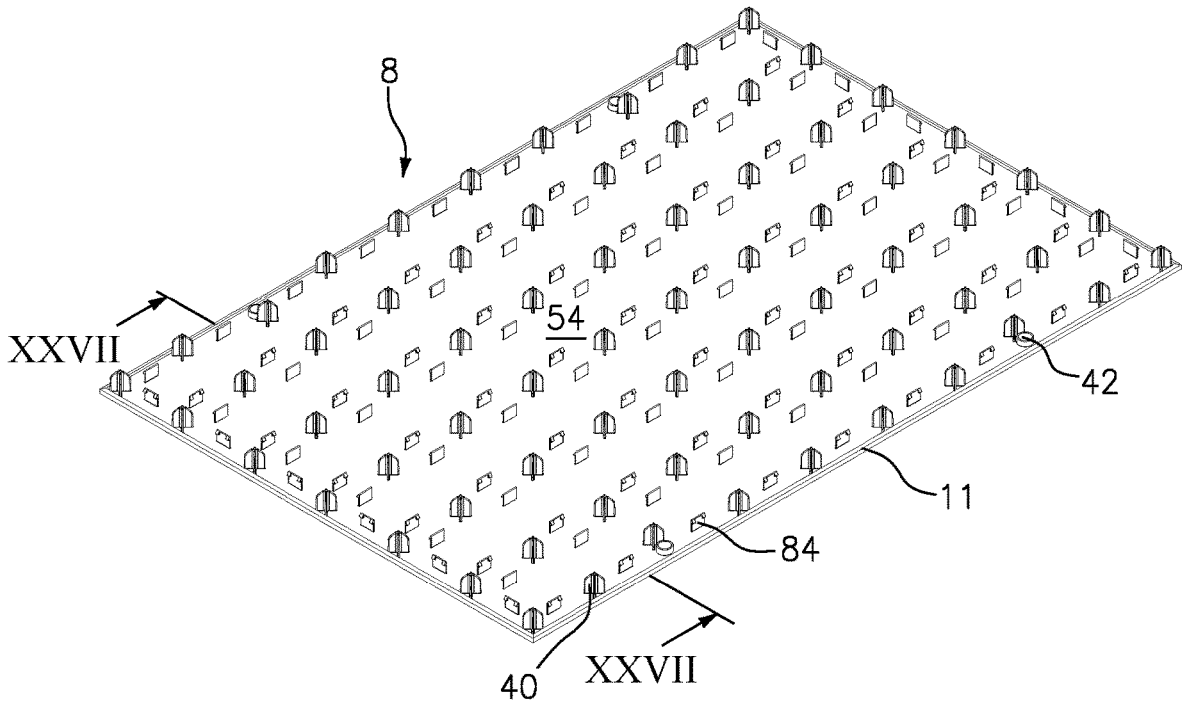
FIGS. 24 to 28 show a fifth embodiment of a formwork panel for concrete-work shutterings according to the invention, wherein in detail.
Figure 25:
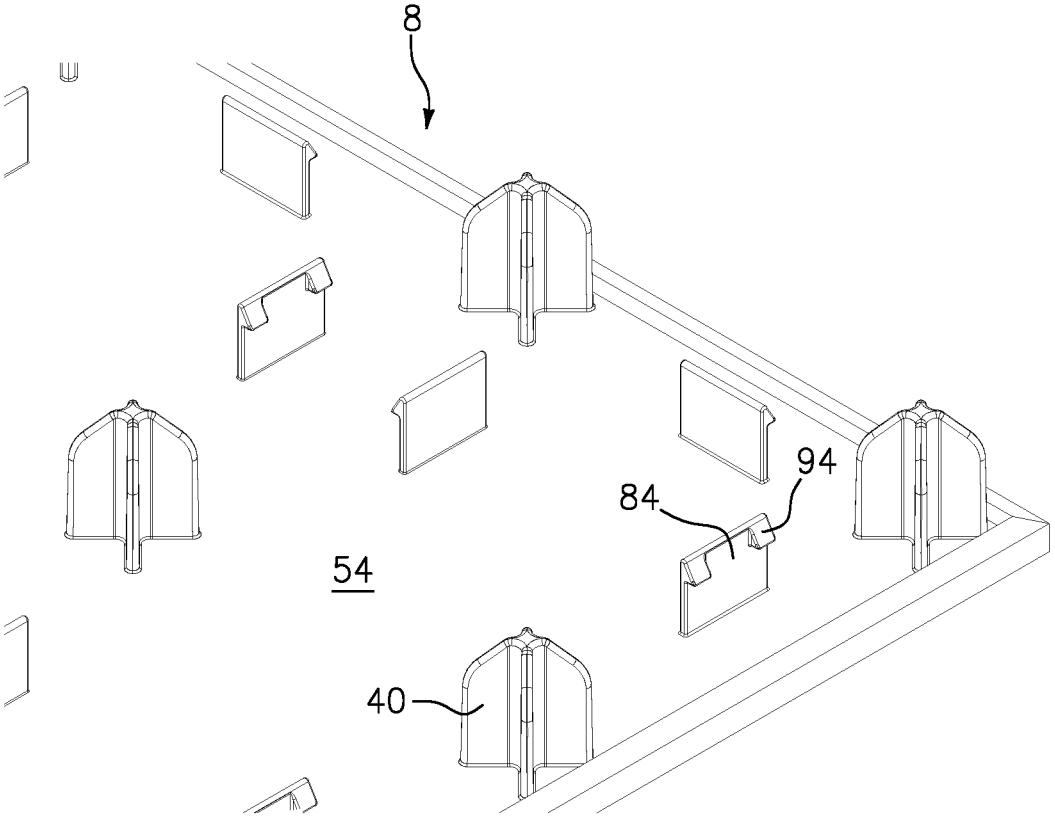
Figure 26:
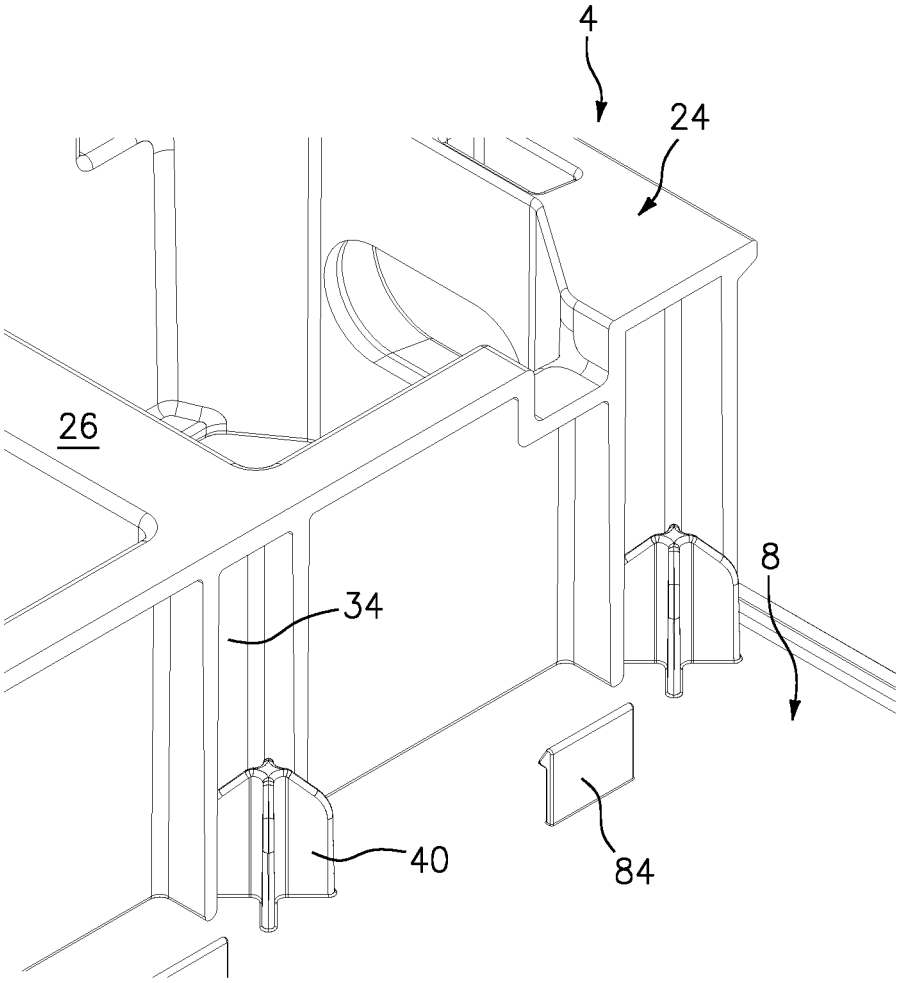

As is evident in particular from FIGS. 24 and 25, the formwork skin element 8 has extensions 40 configured like the extensions in the second embodiment (cf. in particular FIGS. 11 and 13), however without a central, axially extending cavity. There are no screws provided, either, that are threadedly engaged with the extensions 40 from the supporting structure rear side 24. In the fifth embodiment, the extensions 40 in cooperation with the corresponding channels 34 (in female/male engagement each) thus have merely the function of mutually fixing the position of supporting structure 4 and formwork skin element 8 as well as transferring the shear forces mentioned hereinbefore.

In order to mutually anchor the supporting structure 4 and the formwork skin element 8 in tension-proof manner with respect to forces acting perpendicularly to the formwork skin front side 10 in the sense of separating the supporting structure 4 and the formwork skin element 8, the formwork skin element 8 has plate-like extensions 84 molded-on on the rear side thereof. For each opening 20 in the supporting structure 4, the present embodiment is provided with two extensions 84 or three extensions 84 in case of the openings 20 adjacent the edges. However, it is also possible to use a different number of molded-on extensions 84.

Figure 27:
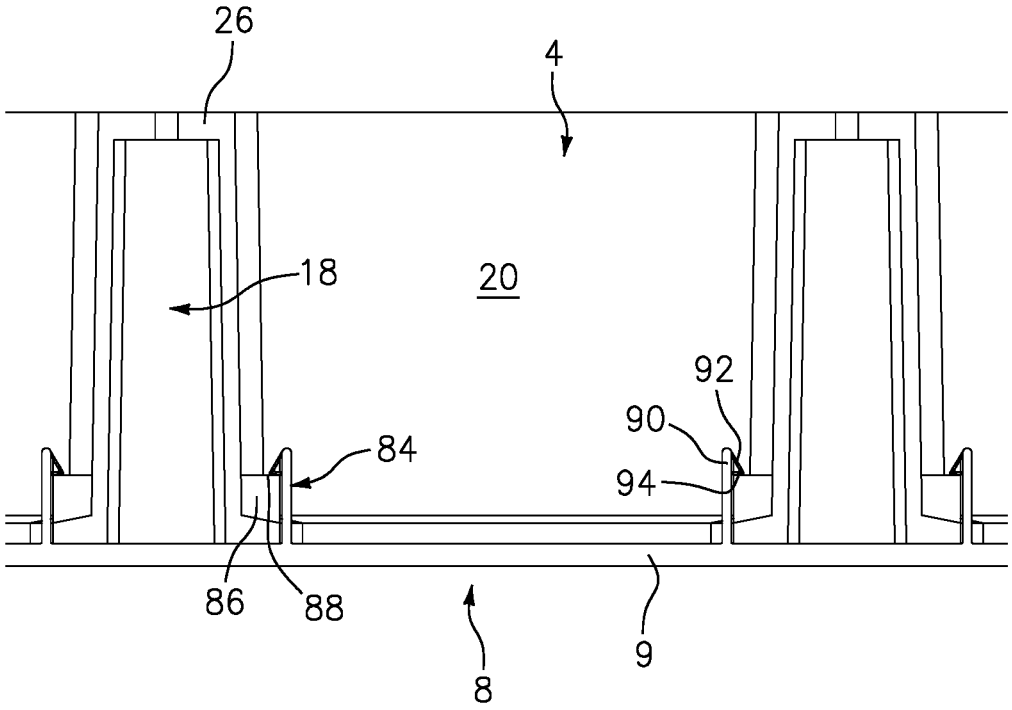
Figure 28:
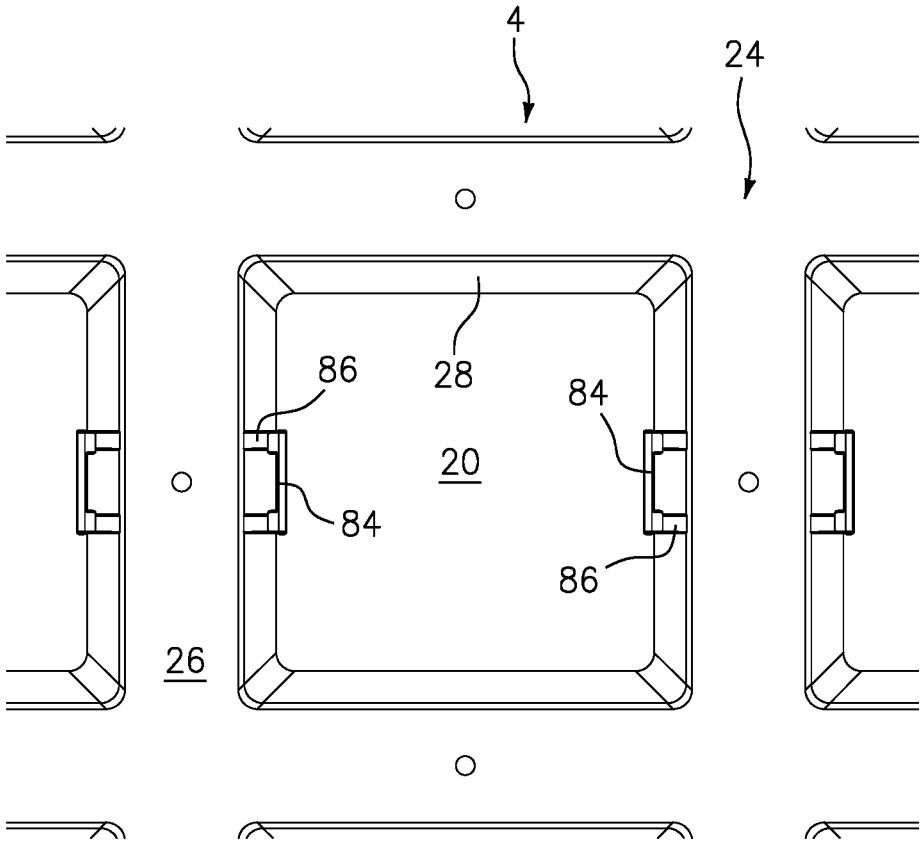

FIG. 27 shows that the openings 20, in those portions close to the supporting structure front side where extensions 84 "enter" upon assembly of supporting structure 4 and formwork skin element 8, are provided with molded-on projections 86 projecting towards the center of the respective opening 20. On the side facing the supporting structure rear side 24, the projections 86 are provided with one shoulder 88 each. The extensions 84, at the end thereof remoter from the plate rear side 54 of the formwork skin element 8, have two protrusions 90 each directed away from the center of the respective opening 20. The protrusions 90 are each tapered at their side facing away from the center of the respective opening 20 (cf. numeral 92) and have a shoulder 94 at their end facing the plate rear side 54.

Upon slidingly engaging the formwork skin element 8 and the supporting structure 4, the extensions 84, due to the cooperation of the inclined surfaces 92 with the insides of the projections 86, are elastically bent towards the inside, i.e. towards the center of the corresponding opening 20. As soon as the formwork skin element 8 and the supporting structure 4 are completely pressed together, the extensions 84 resile outwardly, with the shoulders 94 of the extensions 84 now abutting against the shoulders 88 of the projections 86. The extensions 84 in essence take over no fixing function of the formwork skin element 8 in relation to the supporting structure 4 in directions parallel to the formwork skin front side 10 and no function, either, in taking over the shear forces mentioned hereinbefore. It is to be noted that in FIG. 27, there is purposefully illustrated some minor play—as measured horizontally in FIG. 27—between the respective projections 86 of the supporting structure 4 and the respective extension 84.

Upon bending the extensions 84 towards the center of the respective opening 20 or upon breaking-off of the extensions e.g. using a screwdriver, the formwork skin element 8 can be removed from the supporting structure 4.

Figure 29:
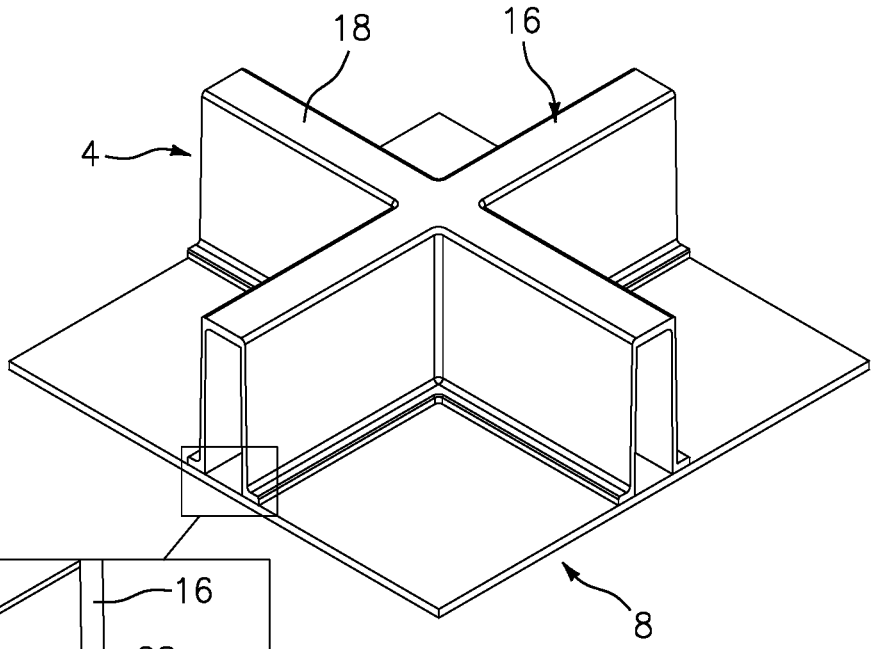
FIGS. 29 and 29A show a sixth embodiment of a formwork panel for concrete-work shutterings according to the invention, in the form of a perspective view of part of the formwork panel, looking onto the formwork panel rear side facing the viewer, with FIG. 29A providing an enlarged partial view of the panel shown in FIG. 29.
Figure 29A:
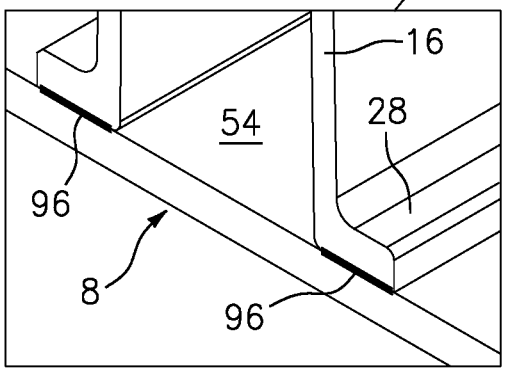

FIG. 29 illustrates that the supporting structure 4 and the formwork skin element 8 can be connected or attached to each other by adhesive connection, instead of using the types of connection described hereinbefore. Between the flanges 28 of the respective double-wall structure with hat-shaped cross-section of the intermediate walls 16 and 18, respectively, on the one hand and the plate rear side 54 of the formwork skin element 8 on the other hand, there is provided a respective thin adhesive strip 96. It is not necessary to provide adhesive strips 96 in all locations where flanges 28 and plate rear side 54 meet together and in the full possible length thereof. The degree of providing adhesive strips 96 is determined by the overall adhesive area necessary for ensuring the desired connecting strength.

The adhesive connection described is releasable when selecting a suitable adhesive material known to the expert and available in the market, which can be released e.g. by a selective solvent.

Figure 30:
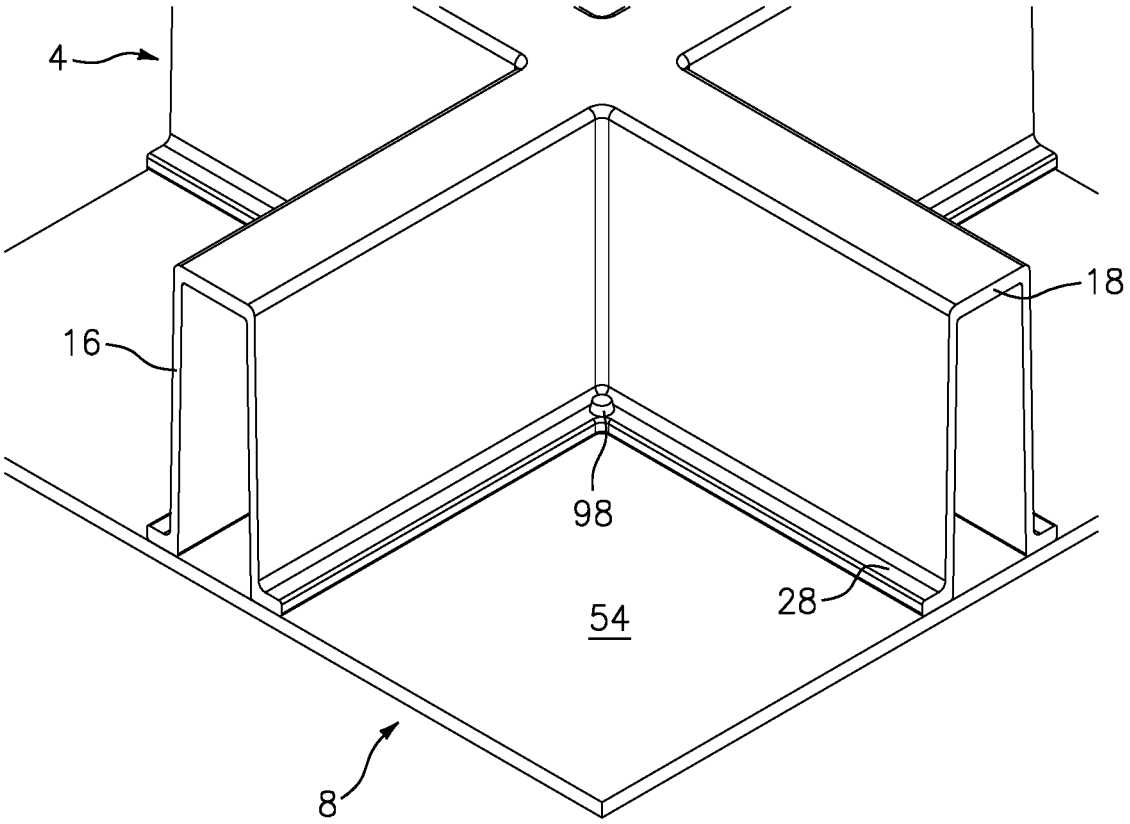
FIG. 30 shows a seventh and an eighth embodiment of a formwork panel for concrete-work shutterings according to the invention, in the form of a perspective view of part of the formwork panel, looking onto the formwork panel rear side facing the viewer.

FIG. 30 illustrates two additional possible kinds for implementing the releasable connection or the releasable mutual attachment of supporting structure 4 and formwork skin element 8 according to the invention.

The first one of the two possibilities consists in molding-on relatively short, pin-like extensions 40 to the plate rear side 54 of the formwork skin element 8, e.g. one pin-like extension 40 each (or also several pin-like extensions 40) in the region of each crossing location or a partial number of crossing locations between intermediate walls 16 and 18 and in the region of each T-location or a partial number of the T-locations between intermediate walls 16 and 18 and a peripheral wall 12 and 14, respectively. At those locations where a connection is to be established by means of a pin-like extension 40, there is provided a respective hole in the supporting structure 4, e.g. at a corner transition of two flanges 28, as illustrated in FIG. 30. The pin-like extension 40 at the beginning has such a length that, upon assembly of the formwork skin element 8 and the supporting structure 4, it projects a certain length from the hole mentioned. The projecting end can be caulked or re-shaped into a wider extension head 98 e.g. by means of a heated punch, as shown in FIG. 30. For releasing the connection between formwork skin element 8 and supporting structure 4, it is possible e.g. to clip-off the plastics head 98 thus formed, using suitable pliers.

An alternative consists in providing a respective rivet instead of the pin-like extensions 40 of plastics material. The rivet head formed in producing the rivet connection e.g. looks like the head designated 98 in FIG. 30. For releasing the rivet connection, the rivet head has to be removed, e.g. by clipping-off using suitable pliers.

All embodiments have been illustrated and described such that only one single formwork skin element 8 constitutes the entire formwork skin 6 of the formwork panel 2. This constitutes the preferred case in the scope of the invention. However, in particular in case of formwork panels 2 of larger format, it may be more expedient to attach several formwork skin elements 8 beside each other on the supporting structure 4, with the border(s) between adjacent formwork skin elements 8 extending either in the longitudinal direction of the formwork panel 2 or in the transverse direction of the formwork panel 2. In that event, each of the formwork skin elements 8 is attached to the supporting structure 4 in a manner as described in exemplary form hereinbefore for the respective single formwork skin element 8.

Suitable plastics materials for forming the supporting structure 4 and the formwork skin 6 are known to the expert and available in the market. As suitable basic plastics materials, polyethylene (PE), polypropylene (PP) and polyamide (PA) should be named here. The supporting structure 4, which bears a major part of the load of the formwork panel 2, may consist in particular of fiber-reinforced plastics materials, with glass fibers and carbon fibers being indicated as favorable examples. It is indeed possible to use comparatively long fibers (length more than 1 mm up to several centimeters). As regards the formwork skin 6, which bears a lesser part of the load applied to the formwork panel 2 and which preferably should be nailable, it is possible in particular to make use of a plastics material that is reinforced by means of granular particles, in particular calcium carbonate or talcum. However, a reinforcement using short fibers (smaller than or equal to 1 mm length), in particular (short) glass fibers, is conceivable as well.

In all embodiments illustrated and described, the plastics material of the supporting structure 4 is of higher strength than the plastics material of the formwork skin element 8 which is nailable.

In the first embodiment, a length l of 135 cm, a width b of 90 cm and a thickness d of 10 cm have been indicated for the formwork panel, with the thickness of the plate-like portion of the formwork skin element 8 being 5 mm. This exemplary indication of dimensions applies for all other embodiments as well. However, it is expressly pointed out that formwork panels 2 configured according to the teaching of the invention may also have still larger formats or smaller formats. When clearly larger formats are to be provided, the material required, however, increases disproportionately so that uneconomical formwork panels are formed which can no longer be handled manually. When, on the other hand, clearly smaller formats are used, erecting and disassembling of concrete-work shutterings becomes more complex; moreover, the number of joints between respective adjacent formwork panels increases, with these joints possibly becoming visible as molded marks in the finished concrete product.

It was already pointed out above in connection with FIG. 1 that, in the first embodiment, the edge on the rear side of the supporting structure 4 all around projects somewhat beyond the outer surfaces of the peripheral walls 12 and 14. The same applies for the plate-like portion 9 of the formwork skin element 8 so that—in other words—the outer surfaces of the peripheral walls 12 and 14 are somewhat recessed with respect to the overall outer contour of the formwork panel 2. However, on the eight corners of the formwork panel parallelepiped, there are small tapers 99 each providing an inclined transition from the outer surface of a peripheral wall 12 and 14, respectively, towards the respective outer edge of the supporting structure rear side 24 and the outer edge of the plate-shaped portion 9 of the formwork skin element 8, respectively.

When several formwork panels 2 are set up or placed beside each other longitudinal side against longitudinal side or transverse side against transverse side or longitudinal side against transverse side, the outer edges of the plate-like portions 9 of adjacent formwork skins 6 establish desirably close contact, so that at the most a minor passage of concrete slurry is possible there. The outer edges of adjacent supporting structure rear sides 24 also establish close contact. The outer surfaces of the peripheral walls 12 and 14, respectively, desirably are arranged with a slight distance from each other, in order not to jeopardize the aforementioned close contacts at the formwork panel front sides and the formwork panel rear sides.

In all of the embodiments illustrated and described, the respective supporting structure 4 and the respective formwork skin element 8 are each constituted by an integral injection-molded component of plastics material or an integral compression-molded component of plastics material, i.e. the supporting structure 4 and the formwork skin element 8 each have a configuration permitting production thereof by plastics injection-molding or by plastics compression-molding.

Looking at first at the supporting structure 4 and the production thereof by injection-molding, it can be seen that the openings 20, including the insides of the flanges 28, the rear halves of the peripheral double-walls 12 and 14 up to the openings 30, as well as the rear surfaces of the material portions 26 closing the intermediate double-walls 16 and 18 on the rear side, are molded by portions of the manufacturing mold from the rear side of the supporting structure 4. The interstices or spaces between the intermediate double-walls 16 and 18 as well as the spaces between the peripheral walls 12 and 14 up to the openings 30 can be molded by portions of the manufacturing mold from the front side of the supporting structure 4. As regards the channels 34, it is determined by the channel shape whether molding is effected completely from the rear side of the supporting structure 4 (e.g. in the first embodiment, cf. FIG. 7), or completely from the front side of the supporting structure 4, or whether part of the channel length is molded from the rear side and the remainder of the channel length is molded from the front side, cf. typically the third embodiment, FIG. 17). For molding the circumferential walls 32 of the openings 30 and the outer surfaces of the peripheral walls 12 and 14, there are used slides of the manufacturing mold, having a direction of movement perpendicularly to the outer surface of the respective peripheral wall 12 or 14.

It is understood that all relevant surfaces of supporting structure 4 and formwork skin element 8 have a so-called draft angle of typically 0.5 to 2 degrees, so that the halves of the manufacturing mold can be opened without any problem, the slides of the manufacturing mold can be withdrawn without any problem, and the plastics product can be ejected from the manufacturing mold without any problem.

As regards the possibility of manufacturing the supporting structure 4 by plastics compression-molding, the above explanations are applicable in quite analogous manner. The most essential difference between plastics injection-molding and plastics compression-molding, in molding thermoplastic plastics material, resides in that in the first case the plastics material is injected in liquid form under pressure, whereas in the second case the plastics material is introduced into the mold cavity in the form of solid grains and is molten therein under pressure.

Considering next the manufacture of the formwork skin element 8 by plastics injection-molding or by plastics compression-molding, it is apparent that the rear side 54 of the plate-like portion 9 of the formwork skin element 8 is a good position for the parting plane of the manufacturing mold so that the extensions 40 can be molded with the aid of free spaces in the one mold half. This is possible in particularly simple manner in the second, third and fourth embodiments. In case of the first and fifth embodiments, there have to be used slides for molding the "barbs" on the extensions 40.

Finally, it is pointed out in addition that in all of the embodiments described and illustrated the formwork skin front side 10 and thus the entire formwork panel front side is free from constituent parts that are related to the means for connecting or mutually attaching the supporting structure 4 and the formwork skin element 8 to each other. In other words, the formwork skin front side 10, except for the openings 42, is completely plane (in the sense in which the term "plane" is usually employed for formwork skins, which does not mean a geometrically level plane in the strict literal sense), so that the surface of the concrete product to be manufactured reveals nothing but the undisturbed surface of the formwork skin 6 and at the most certain marks at the locations where joints between adjacent formwork skins 6 were present.

Figure 18:
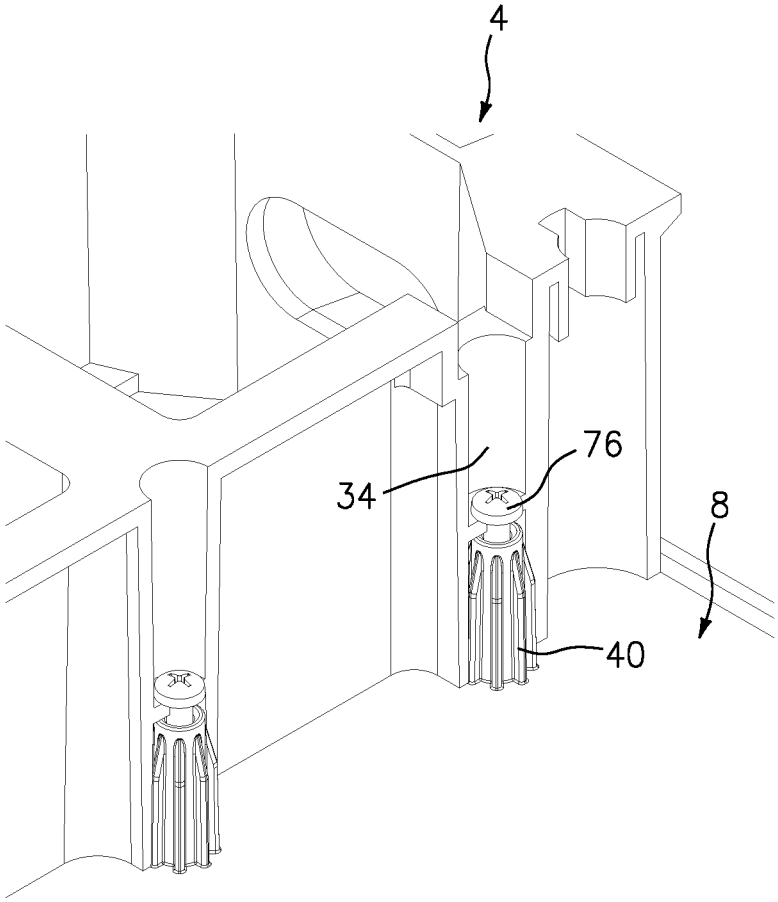
Figure 19:
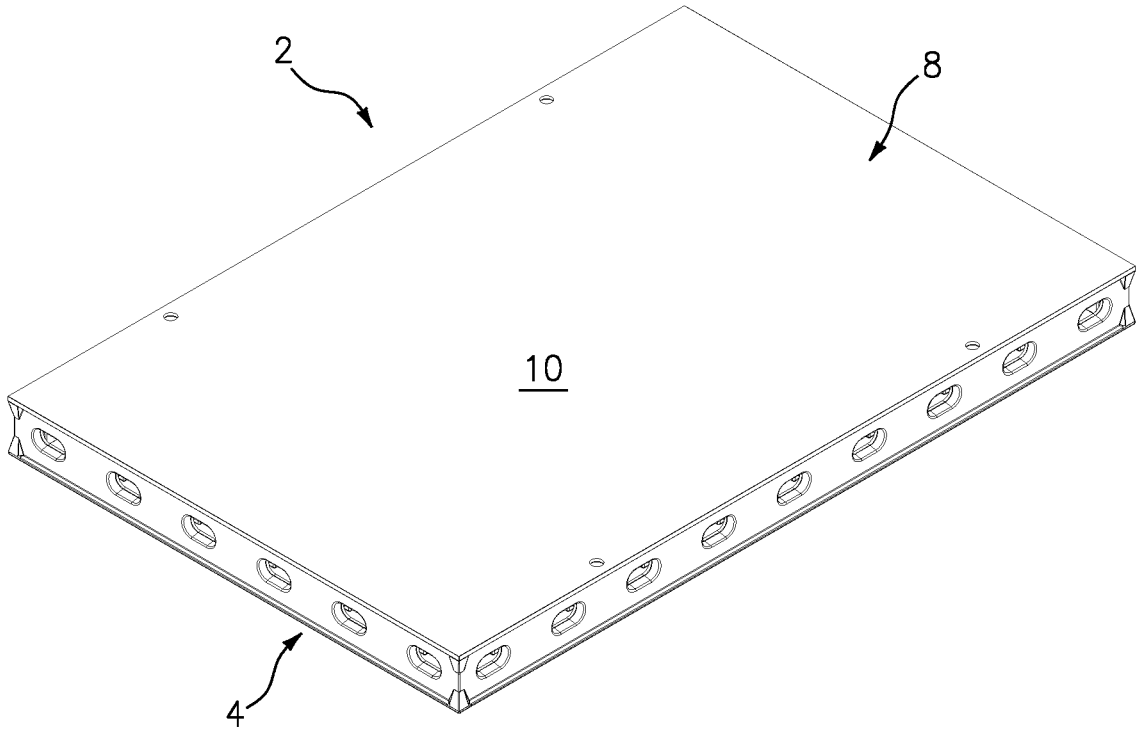
FIGS. 19 to 23 show a fourth embodiment of a formwork panel for concrete-work shutterings according to the invention, wherein in detail.
Figure 20:
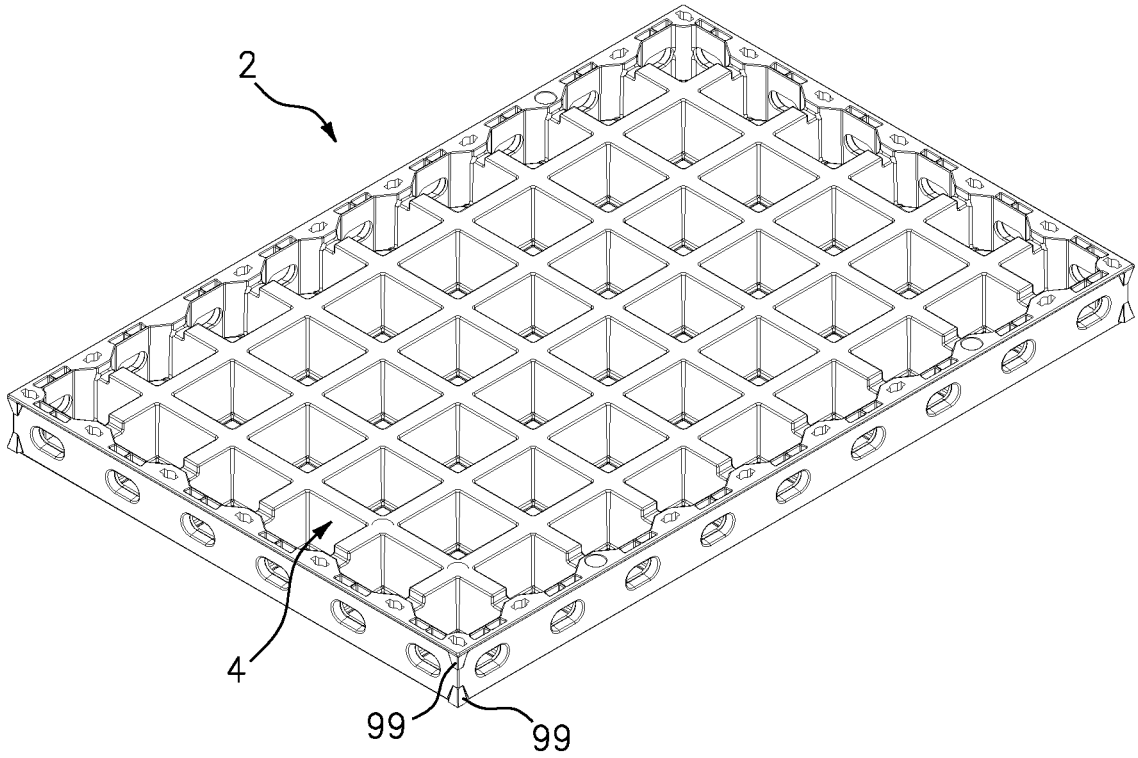
Figure 21:
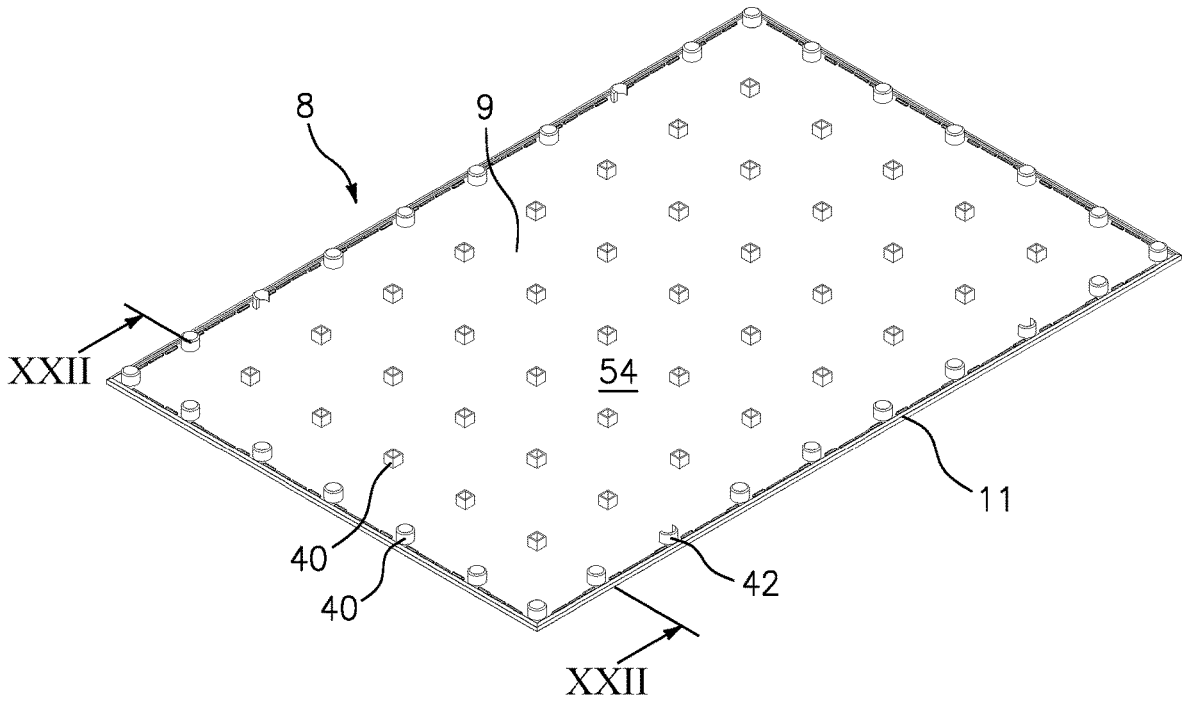

It is pointed out for the sake of completeness that in part of the embodiments illustrated there are shown openings extending perpendicularly to the formwork skin front side 10, which extend through the double-wall structure of the peripheral walls 12 and 14 and, in the end portion adjacent the supporting structure rear side 24, have a shape that can be referred to as circular with two diametrical, substantially rectangular extended portions (shown particularly clearly in FIG. 18 at the upper right; FIG. 23). This configuration of opening end portions has nothing to do with claims features of the present application.

Figure 31:
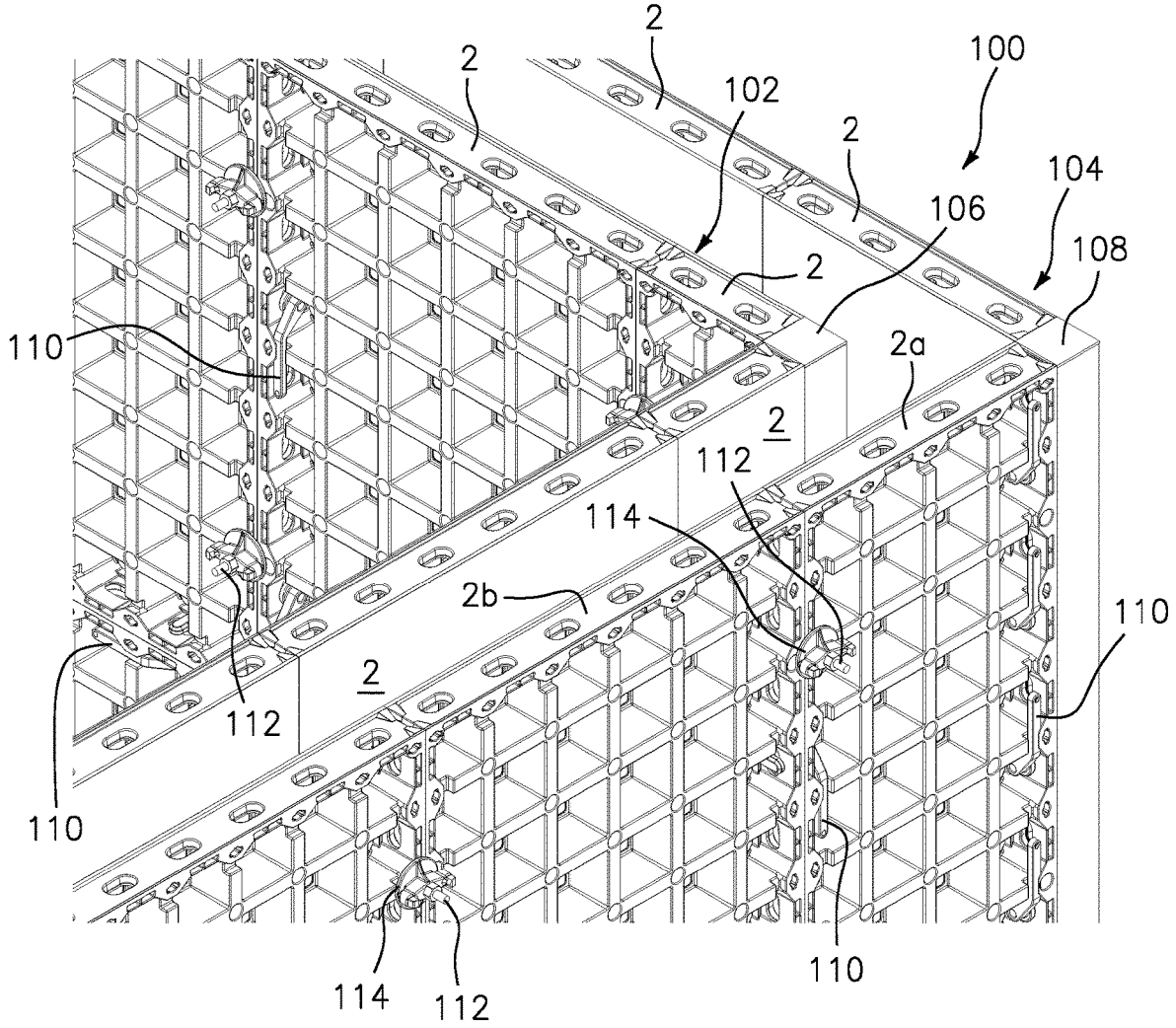
FIG. 31 shows a perspective view of part of a concrete-work wall shuttering, comprising a plurality of formwork panels according to the invention, looking from above obliquely onto the wall shuttering.

FIG. 31 shows a cutout of a concrete-working wall shuttering 100 that is erected using formwork panels 2 according to the invention. In detail, there is illustrated a wall shuttering for a wall extending around a corner of 90°. It is of course possible to erect wall shutterings for straight walls, for columns, for walls merging with each other in a T-shape etc. in corresponding manner, with the principles described hereinafter being applicable in all of these cases in corresponding manner.

In the embodiment of FIG. 31 all formwork panels 2 are "aligned vertically", i.e. the longitudinal direction l of the same extends vertically and the width direction b or transverse direction of the same extends horizontally. The formwork panel front side 10 extends vertically in all formwork panels 2. "Horizontally aligned" formwork panels 2, i.e. longitudinal direction l extends horizontally and transverse direction b extends vertically, can be used in part or in all situations.

Starting from the inner corner 102 of the wall shuttering 100, there can be seen in total four formwork panels 2 in full width (in one case, to the upper left, only in almost full width). In addition, there can be seen two formwork panels 2, in which part of the width is cut off. Furthermore, there is shown a vertical post 106 of square cross-section directly at the inner corner.

Two of the formwork panels 2 shown in full width b have dimensions identical to the dimensions of the formwork panels in all embodiments according to FIGS. 1 to 30, i.e. eight transverse intermediate walls 18 and five longitudinal intermediate walls 16 and nine openings 20 in series when progressing in longitudinal direction, as well as six openings 20 in series when progressing in transverse direction. Adjoining the post 106 around the corner, there are two formwork panels 2 of comparatively lesser width b. In detail, the width b thereof is one third of the width of the "full-size formwork panels 2", i.e. there are only two openings 20 in series when progressing in transverse direction. The length l of the latter formwork panels 2 is equal to the length l of the full-size formwork panels 2. On the outside of the corner of the concrete wall to be manufactured, there can be seen—directly at the corner—another post 108 corresponding to post 106 and followed around the corner by two formwork panels 2 of ⅔ width as compared to the width b of a full-size formwork panel 2. The latter formwork panels 2 are followed on both sides by full-size formwork panels 2.

It is emphasized that FIG. 31 shows so to speak only the upper half of a wall shuttering portion. A second, lower half follows in downward direction, as will still be described in more detail. The wall shuttering in total then has a height of 270 cm, which in building construction is a quite common ceiling height from the concrete floor to the bottom side of the ceiling.

In the right-hand third of FIG. 31, at the lower portion, it can be seen that and how respective adjacent formwork panels 2 are coupled and the last formwork panel 2 is coupled to post 108. When going down at the last outside-corner formwork panel 2*a* at the left-hand vertical edge to the fourth opening 20, there can be seen part of a coupling element 110. At the right-hand vertical edge of the same formwork panel 2*a*, there can be seen four coupling elements 110 of the same type. Also in the left-hand third of FIG. 1, at the top portion, there can be seen a coupling element 110 of the same type. Coupling elements 110 of this type will be described in more detail further below by way of FIGS. 33 to 35. It is sufficient to point out here that such coupling elements 110, engaging through pairs of openings 30 in the peripheral walls 12, are capable of effecting coupling of adjacent formwork panels 2 or coupling of a formwork panel 2 to a post 106 or 108, respectively.

At the very left, in the middle of FIG. 31, there can be seen that and how coupling elements 110 of the same type are adapted to couple two vertically adjoining formwork panels 2 to each other by having the respective coupling element 110 engage through a pair of openings 30 in transverse peripheral walls 14 of two formwork panels 2.

Moreover, FIG. 31 at several locations shows the ends of tie anchors 112 (of the type already mentioned hereinbefore) which by means of a nut plate 114 are fixed against the supporting structure rear sides 24 of two aligned, adjacent formwork panels 2. The tie anchor rod 112, as described in more detail in connection with the first embodiment, extends through a channel of only one supporting structure 4 which extends at right angles to the formwork skin front side 10. The adjacent formwork panel 2 is included in the pressing operation via the nut plate 114.

It is understood that the vertical alignment of the formwork panels 2 and maintenance of this vertical alignment under the pressure of the poured-in concrete is ensured in appropriate intervals along the wall shuttering 100 by means of push-pull props attached on the one hand on the ground and on the other hand on formwork panels 2.

Figure 32:
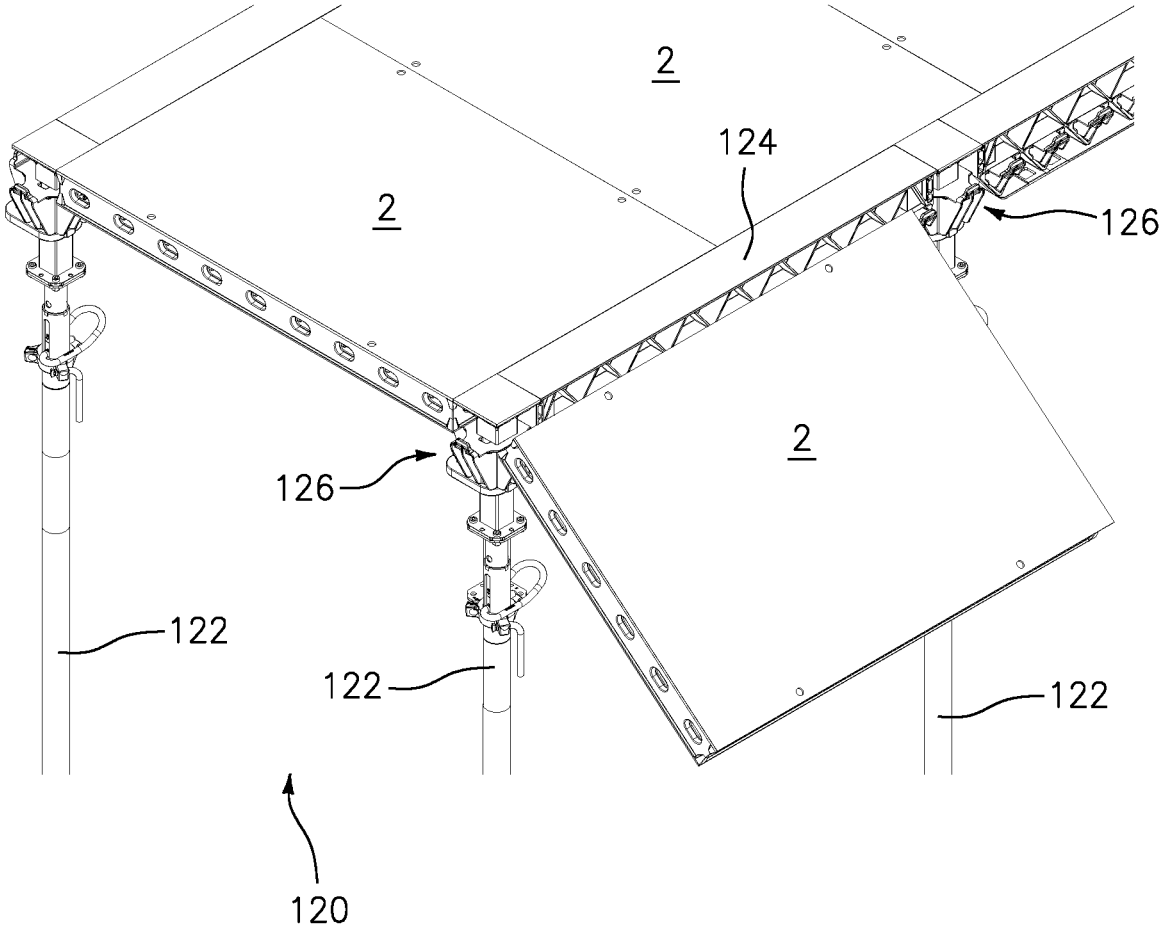
FIG. 32 shows a perspective view of part of a concrete-work ceiling shuttering comprising a plurality of formwork panels according to the invention, looking from above obliquely onto the ceiling shuttering.

FIG. 32 illustrates merely by way of an example (of numerous examples possible) how a concrete-working ceiling shuttering 120 can be designed using formwork panels 2 according to the invention.

In the central portion of FIG. 32, there can be seen part of a row of ceiling shuttering props 122, with this row extending from the lower left to the upper right in FIG. 32 and with only two ceiling shuttering props 122 of a larger number of ceiling shuttering props 122 of this row being illustrated. Further to the upper left in FIG. 32, there is shown another ceiling shuttering prop 122 belonging to a further row of ceiling shuttering props 122 extending from the lower left to the upper right. Within each row of ceiling shuttering props 122, a formwork panel beam 124 extends from one ceiling shuttering prop head 126 to the next ceiling shuttering prop head 126. The longitudinal central line of the row described first as well as the longitudinal central line of the row described second are spaced apart by a distance which in essence corresponds to the length I of the formwork panels 2 inserted between the rows, plus twice half of the width of a formwork panel beam 124.

It is pointed out that, instead of the construction of a ceiling shuttering 120 using the formwork panels 2 according to the invention, as shown in FIG. 32, it is also possible to realize in particular ceiling shutterings 120 in a construction with so-called main beams and so-called auxiliary beams. For this situation, one has to imagine on the basis of FIG. 32 that the interval between the parallel formwork panel beams 124 is not bridged by formwork panels 2, but by a series of auxiliary beams placed parallel to each other (in this case the distance between the formwork panel beams 124 illustrated is normally larger). In this event, the beams extending from prop 122 to prop 122 are referred to as "main beams", and the beams extending at right angles thereto and placed on the main beams are referred to as "auxiliary beams". The formwork panels 2 then are placed such that they each bridge the distance between two adjacent auxiliary beams. Thus, in this case the auxiliary beams are those beams which in the present application are referred to as formwork panel beams.

An embodiment of a coupling element 110 will now be described by way of FIGS. 33 to 35, which in particular can be used with wall shutterings 100 according to the invention, but also for other purposes of which examples will be given further below.

The coupling element 110 illustrated on the whole has a configuration resembling a door handle with integrated shaft, with the coupling element 110 in total being pivotable about the central axis 144 of said shaft. The coupling element 110 may consist in particular of metal or of plastics material.

The coupling element 110 has a shaft portion 140 and, integrally with the shaft portion 140, an elongate handle portion 142 extending in a plane located at right angles to the imaginary central axis 144 of the shaft portion 140. The handle portion 142 itself is bent by approx. 45° in its plane, relatively close to the shaft portion 140. The straight, longer part 146 of the handle portion 142 can be grasped by the hand of a worker and, with the assistance of a leverage established by the distance grasping location/central axis 144, the shaft portion 140 then can be rotated about its central axis 144.

The handle portion 142 integrally merges with the shaft portion 140 at a first end portion of the same. In a slight distance apart from this transition location, the shaft portion 140 has a first flange 148 arranged thereon in the form of an annular outwardly projecting flange. In a clear distance a from the first flange 148, there is provided a second flange 150 in the second end portion of the shaft portion 140, said second flange 150 having a more complex shape that will still be described in more detail below. The clear distance a—for the time being roughly speaking—is approximately of a size which, in case of wall ceiling formwork panels 2 erected side by side in aligned manner, corresponds to the summed thickness of two peripheral walls 12 or 14 in the region of the vicinity around a corresponding opening 30, and added thereto the (small) clear distance between the outer surfaces of the pair of peripheral walls 12 and 14, respectively, as described in connection with the first embodiment and the recessed state of the outer surface of the peripheral walls 12 and 14, respectively. This can be seen in FIG. 31 and in an enlarged scale in FIGS. 34 and 35.

Between the first flange 148 and the second flange 150, the shaft portion 140 in an intermediate flange portion 141 is only substantially circular-cylindrical. To be more specific, the shaft portion 140 at that location has a slightly elongate cross-section, which can be described as "oval-like" or "resembling an ellipse" or as "two semi-circles with two straight portions in between". This cross-sectional shape is not visually apparent in FIG. 33 as the "thickness" or the "local diameter" at the shortest location is only slightly smaller than at the longest location that is approx. 90° apart. The function of this cross-sectional shape will be described in more detail further below.

Figure 33B:
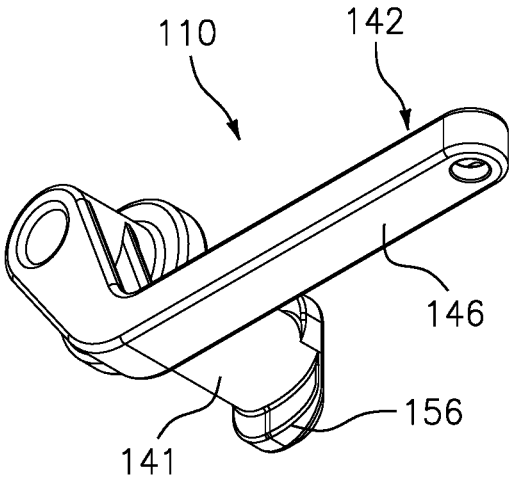
FIGS. 33A-33C show a coupling element for formwork panels according to the invention, with FIG. 33A showing a first perspective view of the coupling element, and FIG. 33B illustrating a second perspective view of the coupling element, and FIG. 33C illustrating a side view of the coupling element.
Figure 33C:
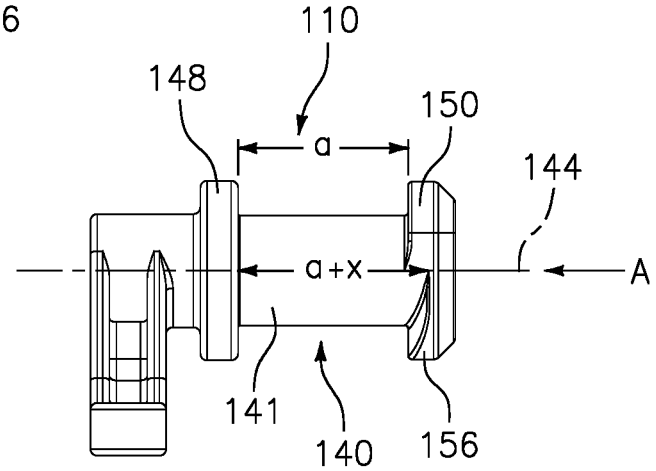
Figure 33A:
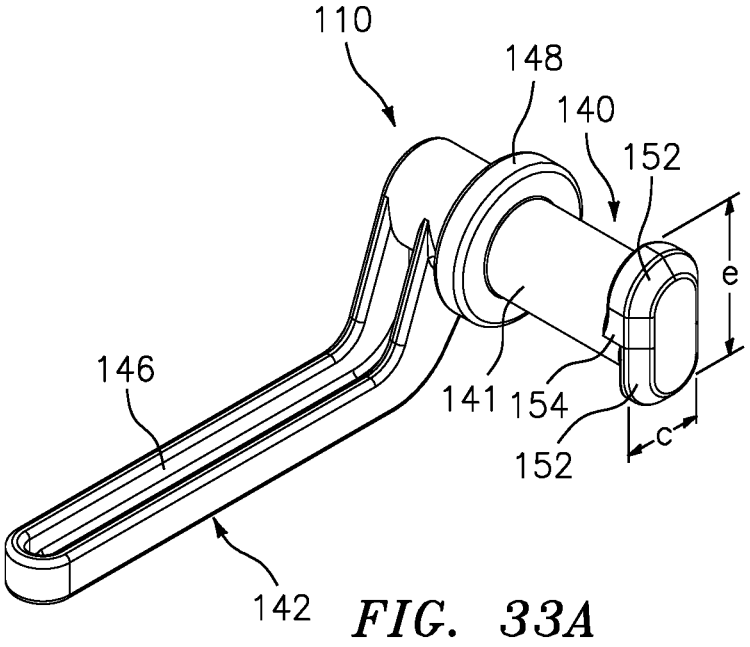

Looking at that end face of the shaft portion 140 where the second flange 150 is located, cf. arrow A in FIG. 33(*c*), the second flange 150 has an oval outer contour, and thus a semicircular section 152 at each end and a straight section 154 between each thereof on both sides. In the central portion between the two semi-circular sections 152, the second flange 150—as measured at right angles to the course of the straight sections 154 between the semicircular sections 152—has a width c which corresponds to the smallest thickness or the smallest diameter of the only substantially circular-cylindrical portion 141 of the shaft portion 140, or is slightly smaller than the same. As measured at right angles to the width c, the second flange 150 has a dimension e that is clearly larger than the width c. In other words, the amount of radial projection of the second flange 150 beyond the circumferential surface of the only substantially circular-cylindrical portion 141 of the shaft portion 140, when progressing by 90°, increases from 0 to a maximum amount, and when progressing by a further 90°, decreases from the maximum amount to 0, and when then progressing by a further 90°, increases from 0 to a maximum amount and, when progressing by a further 90°, then decreases from the maximum amount to 0.

FIG. 36B and FIG. 36C, each at the lower right, show that the end face of the second flange 150 facing the first flange 148 is not level, but is divided into two parts (with the first part corresponding to the just described first radial extension increasing/radial extension decreasing course across 180°, and the second part corresponding to the just described second radial extension increasing/radial extension decreasing course across 180°); in each of these two parts, an approx. half, 90° partial region is formed as wedge surface 156 which, when progressing in circumferential direction, gradually decreases from a maximum distance a+x from the opposite end face of the first flange 140 to a distance a from the opposite end face of the first flange 148.

On the basis of the geometry described of the shaft portion 140 with the second flange 150 of the coupling element 110, it is possible to insert the shaft portion 140 with the second flange 150 leading into an aligned pair of openings 30 of two parallel peripheral walls 12 or 14 of two adjacent formwork panels 2. As pointed out hereinbefore, the openings 30 are of oval shape or in the shape of an elongate hole, and the described oval shape of the second flange 150 is such that the shaft portion 140, with the second flange 150 leading, can just be inserted through the two openings 30 when the larger dimension e of the second flange 150 coincides with the larger length of the oval opening 30. The beginning of this insertion operation can be seen in FIG. 34 at the right-hand coupling element 110, and the end of this insertion operation can be seen in FIG. 34 at the left-hand coupling element 110 from the side of the second flange 150. In the fully inserted state, the end face of the first flange 148 facing the second flange 150 is in contact with the portion of the respective peripheral wall 12 or 14 of the formwork panel 2 surrounding the respective opening 30.

Upon termination of the insertion operation described, the second flange 150 of the respective coupling element 110 is located completely on the inside of the respective peripheral wall 12 or 14 of the second formwork panel 2 (with the second formwork panel 2 designating here the formwork panel 2 the opening 30 of which is passed by the second flange 150 as second opening of the pair of openings 30). Consequently, the coupling element 110 can be rotated or pivoted by means of the handle portion 142 about the central axis 144 thereof, in counterclockwise direction when looking at that end face of the shaft portion 140 where the handle portion 142 starts. In the right-hand coupling element 110 in FIG. 34, the pivotal movement would be visible in counterclockwise direction if the introduction of the shaft portion 140 had already been carried out. In the left-hand coupling element 110 in FIG. 37, in which the insertion operation has already been carried out, the pivotal movement of the handle portion 142 would be seen as pivotal movement in clockwise direction, as one looks in this case onto the end face of the shaft portion 140 where the second flange 150 is provided.

Figure 35:
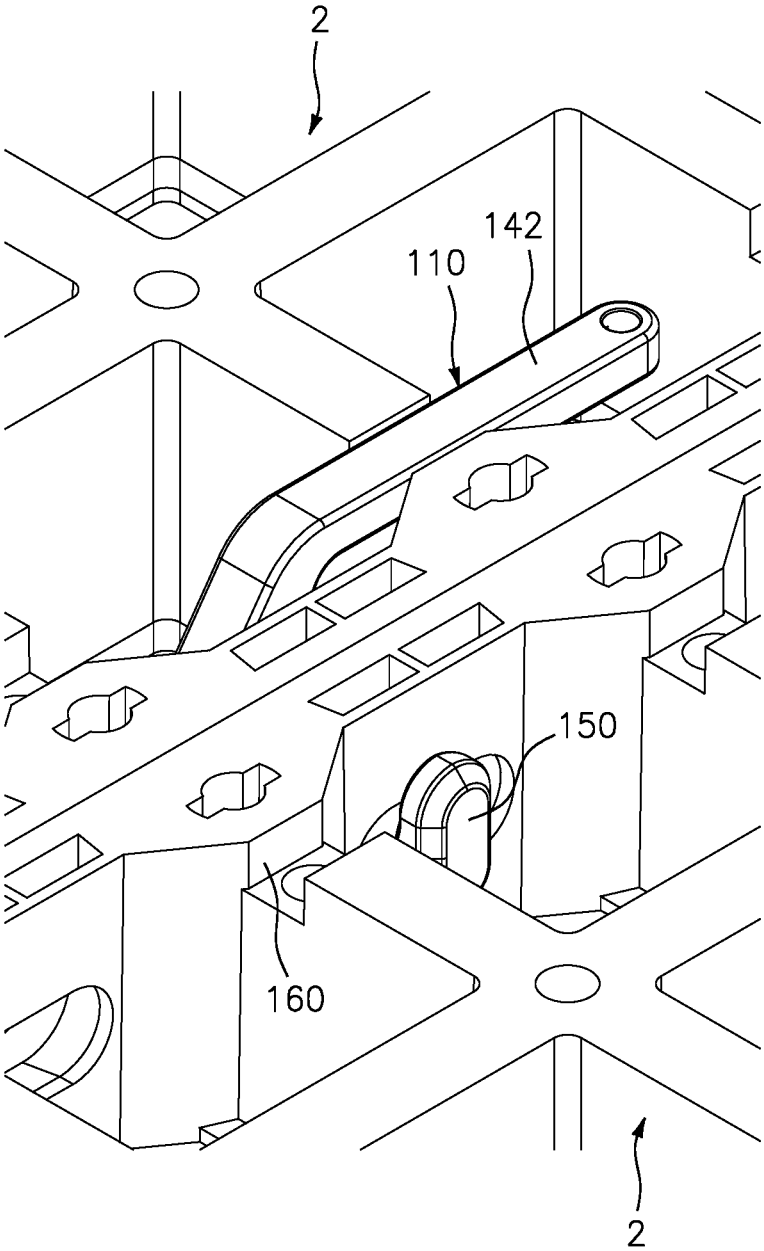
FIG. 35 shows a perspective view of a coupling element of FIGS. 33 and 34 in the finished, installed state on a pair of formwork panels according to the invention.

FIG. 35 illustrates the state in which the handle portion 142 has been pivoted completely by 90°. The second flange 150 (like the first flange 148) have performed a rotational motion of 90° about the central axis 144. The larger dimension e of the second flange 150 now extends perpendicularly to the larger dimension of the adjacent opening 30 there in a peripheral wall 12 of 14 of a formwork panel 2. The pair considered of the peripheral walls 12 or 14 is clamped together between the first flange 148 and the second flange 150. The adjacent formwork panels 2 are coupled to each other at this pair of peripheral walls 12 or 14. Depending on the dimensions of the formwork panels 2 and the loads to be expected, it is possible to employ one coupling element 110 or several coupling elements 110 along the pair of peripheral walls 12 of 14 considered. Moreover, it can be seen that, in the clamping position of the coupling element 110, the longer, straight portion 146 of the handle portion 142 is arranged parallel to the respective formwork panel rear side 24 and, moreover, has part of its length located in a suitable recess 160 which in the intermediate walls 16 and 18 is provided in the rear portion near the peripheral walls 12 and 14 each.

In the initial phase of the aforementioned clamping pivotal movement of the shaft portion 40 and thus of the second flange 150, the two wedge surfaces 156 of the second flange 150 establish contact with the edge portion of the respective opening 30, so that the two participating peripheral walls 12 or 14 are increasingly clamped together in the course of the pivotal movement by approx. 45°. In the course of continuing the pivotal movement by additional approx. 45°, that part of the first-flange-facing end face of the second flange 150 establishes contact with the inner surface of the respective peripheral wall 12 or 14 at which part the clear distance from the opposite end face of the first flange 148 is no longer in changing manner a+x, but is constantly a. When the pivotal movement across approx. 90° has been completed, there is thus established face-to-face contact with the inner surface of the respective peripheral wall 12 or 14 at that location.

The aforementioned smallest thickness or smallest diameter of the only substantially circular-cylindrical portion 141 of the shaft portion 140 of the coupling element 110 extends in a direction parallel to the orientation of the width c of the second flange 150 and is somewhat smaller than the—as measured perpendicularly to the formwork skin front side 10—shorter dimension of the respective opening 30 or the respective two openings 30. When the longer dimension e of the second flange 150 and the largest thickness or the largest diameter of the portion 141 of the shaft portion 140 are substantially aligned with the longitudinal direction of the participating openings 30, the second flange 150 and the portion 141 of the shaft portion 140 can be inserted conveniently and with clearance into the pair of the participating openings 30, even in case the two participating formwork panels 2 have some offset from each other in a direction perpendicular to the formwork skin front sides 10. In the subsequent pivotal movement of the coupling element 110 by approx. 90°, the largest thickness or the largest diameter of the portion 141 gradually establishes contact with those central portions of the opening circumferential walls 32 of the two participating openings 30 where the distance of opposing opening circumferential wall portions is smaller than in opening longitudinal direction. The pivotal movement of the coupling elements 110 pulls the two participating formwork panels 2 into a front-sides aligning position since the largest thickness or the largest diameter of the portion 141 of the shaft portion 140 only with some play is as large as the respective size of the openings 30 of the two participating formwork panels 2, as measured in the central opening portion and perpendicularly to the formwork skin front side 10.

It is emphasized that the two peripheral walls 12 or 14 of the two participating formwork panels 2 can also be clamped together with a certain offset in the longitudinal direction of extension of the peripheral walls 12 of 14. Upon completion of the insertion operation described, it is possible to displace the two participating peripheral walls 12 or 14 relative to each other by a certain distance in the longitudinal direction of the peripheral walls 12, 14, and to pivot the respective coupling element 110 into the clamping position only thereafter.

Figure 34:
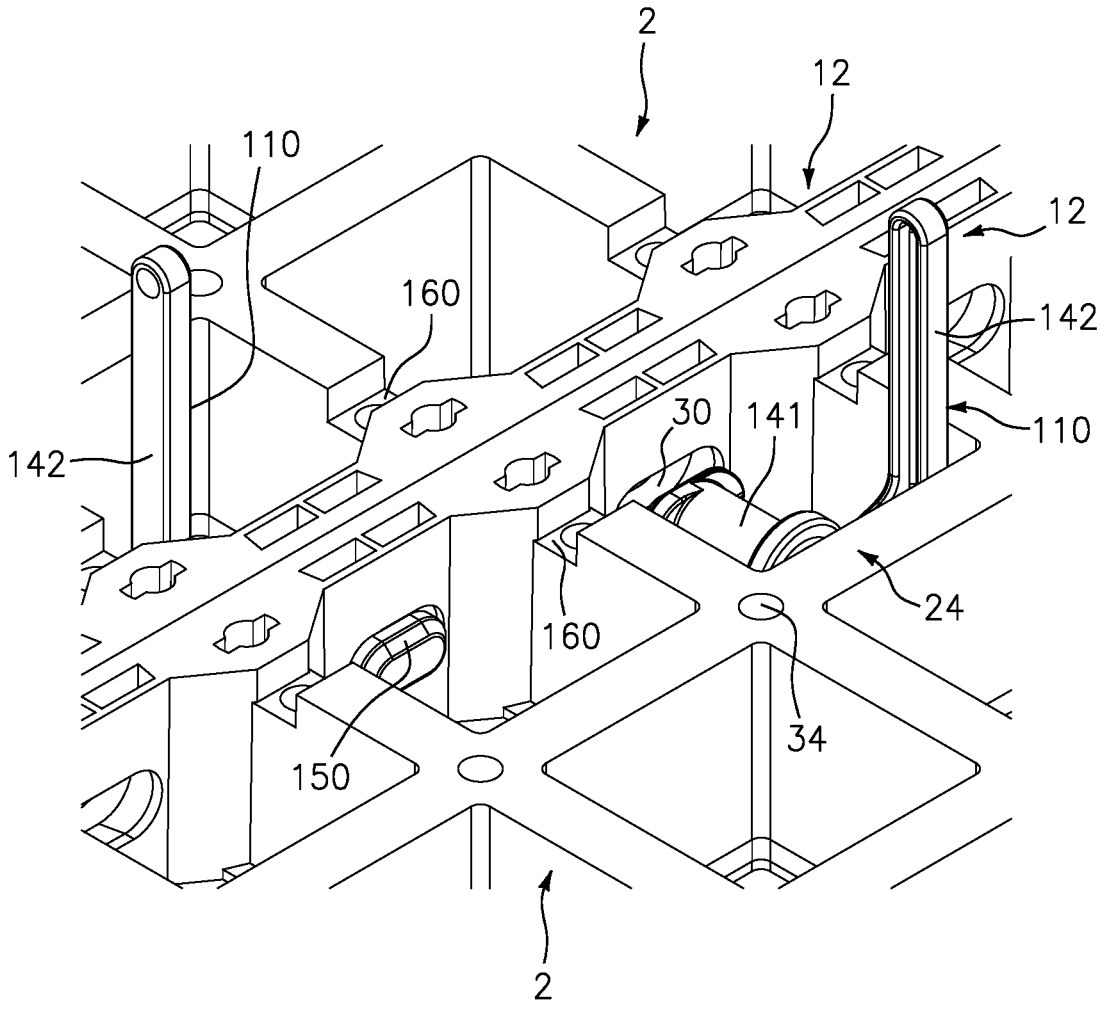
FIG. 34 shows a perspective view of two coupling elements (e.g., as shown in FIGS. 33A-C) in two different states during installation on a pair of formwork panels according to the invention.

The openings 30 in the peripheral walls 12 and 14 are also suitable for coupling shuttering accessories there; depending on the configuration of the portion to be coupled of the respective shuttering accessory, it is possible to use coupling elements as illustrated in FIGS. 33 to 35 and described by way of these figures, or also modified coupling elements which are each engaged with one of the openings 30 or with an aligned pair of openings 30. For example, it is possible to use coupling elements having a different flange distance a. As exemplary cases of shuttering accessories to be coupled particularly frequently in practical application, push-pull props or formwork brackets can be named. However, it is also possible to provide an additional connecting or attachment possibility at other locations of the supporting structure 4 for shuttering accessories.

It is emphasized that the illustrated and described coupling element 110 with its first flange 148 and its second flange 152 indeed constitutes a particularly advantageous embodiment of a coupling element 110 used in the invention, but that coupling elements of other designs, also with a clamping mechanism different from the wedge surface 156, are usable with the invention as well. However, advantageous are coupling elements that cooperate with the openings 30 described in the peripheral walls 12 and 14 of the respective formwork panel 2 and the respective surroundings of the same, as it is possible there in unproblematic manner to provide for the necessary local stability or strength of the respective formwork panel 2.

A ninth embodiment of a formwork panel 2, inclusive of a modification of this formwork panel 2, will now be described by way of FIGS. 36 to 38.

Figure 36:
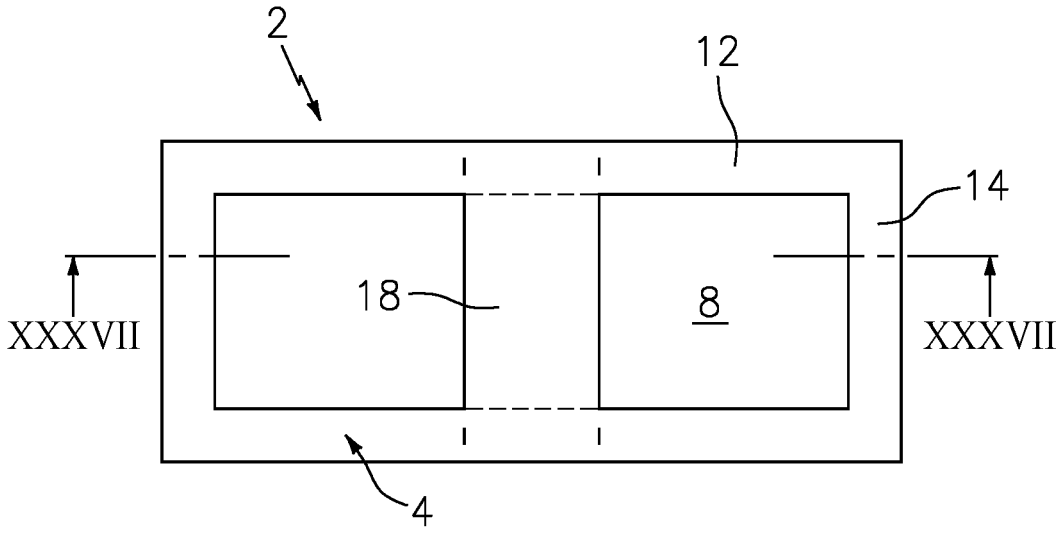
FIGS. 36 to 38 show a ninth embodiment of a formwork panel for concrete-work shutterings according to the invention, as well as a modification of this tenth embodiment, wherein in detail.
Figure 37:
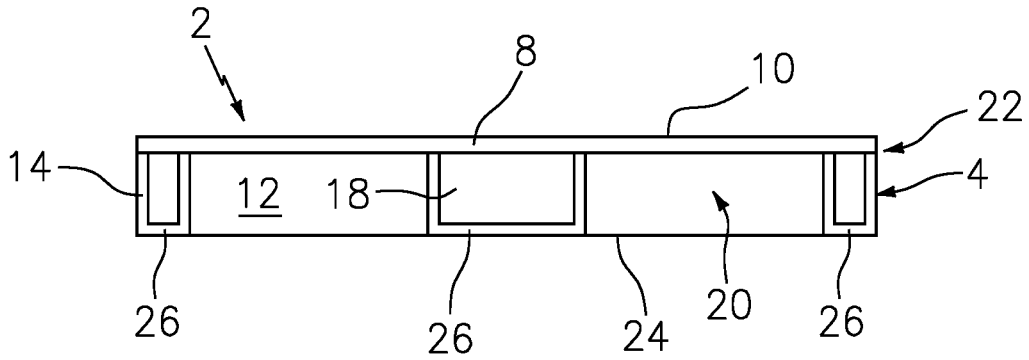
Figure 38:
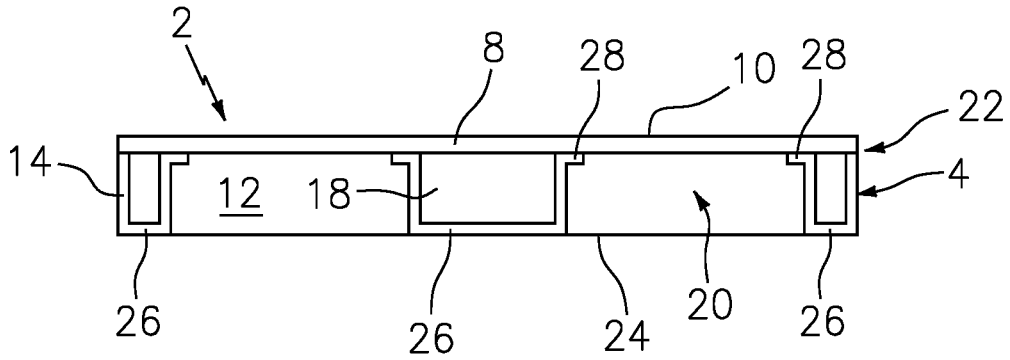

The formwork panel 2 illustrated in FIGS. 36 to 38 is joined together from two constituent parts, namely a supporting structure 4 and a formwork skin 6 which in the instant case is constituted by a single formwork skin element 8. Both the supporting structure 4 and the formwork skin element 8 consist completely of plastics material in this embodiment.

Each of the two longitudinal edges of the supporting structure 4 is in the configuration of a double-walled wall 112, and each of the two transverse edges of the supporting structure 4 is in the configuration of a double-walled wall 14. Between the transverse peripheral walls 14 and parallel to the same, there is a transverse intermediate wall 18 of double-walled design, with the distance between the partial walls of the latter wall being larger than in case of the peripheral walls 12 and 14. Between the walls 12, 14, 18 described and surrounded by the same, there are formed two large openings 20 each having the shape of a quadrangle in plan view and extending in continuous manner from the front side 22 to the rear side 24 of the supporting structure 4. Instead of only one single transverse intermediate wall 18, as illustrated, there could also be provided several transverse intermediate walls 18.

FIG. 37 shows that the double walls 12, 14, 18 are closed on the rear side 24 of the supporting structure 4 by material portions 26 extending parallel to the formwork skin front side 10, whereas they are open at the front side 22 of the supporting structure 4, i.e. they have a space between the partial walls. This configuration is referred to as U-shaped cross-section of the double wall. The modified embodiment according to FIG. 38 differs from the embodiment according to FIG. 37 merely in that the double walls 12, 14, 18, in the respective end portion thereof adjacent the front side 22 of the supporting structure 4, each have a wall-enlarging flange 28 projecting towards the respective opening 20, as it was already described and illustrated with respect to the first embodiment according to FIG. 8 and with respect to the sixth embodiment according to FIG. 29. This configuration is referred to as hat-shaped cross-section of the double wall.

Figure 4A:
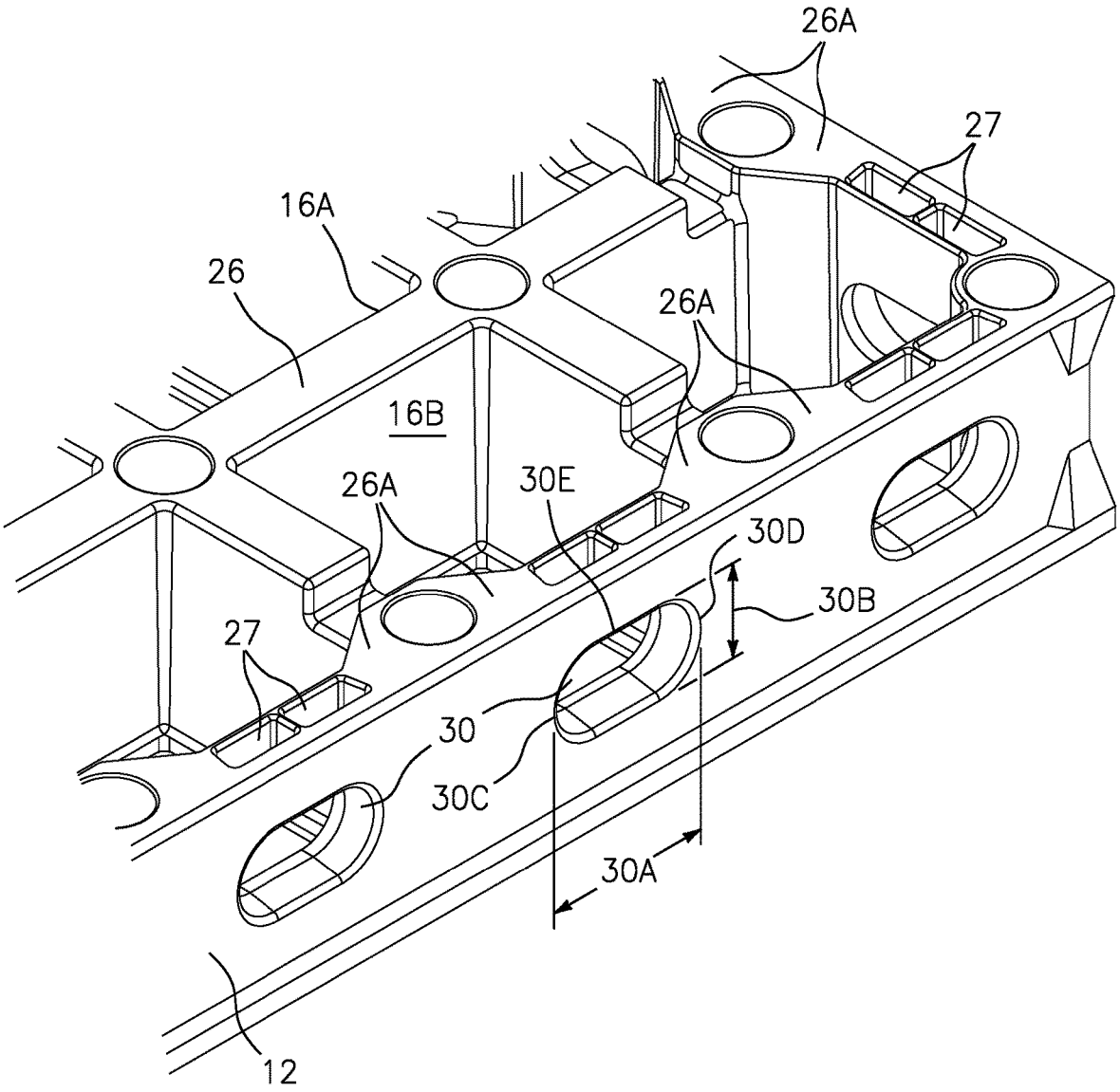
FIG. 4A is an enlarged partial view of the supporting structure shown in FIG. 4, showing an enlargement of a wall opening.

The rear closing of the space between the partial walls of the transverse intermediate wall 18 by the material portion 26 there is substantially continuous and possibly is interrupted only by channels 34 and 42 of comparatively small cross-section, which are continuous from the front side 22 to the rear side 24 of the supporting structure 4, as was already described and illustrated in the preceding embodiments. In the peripheral walls 12, 14, the closing of the space between the partial walls by the material portions 26 located there is interrupted to a greater extent and so to speak is divided into sections (e.g., material portions 26A and openings 27 as shown in FIG. 4A), as illustrated and described in more detail in the preceding embodiments.

A tenth embodiment of a formwork panel 2 according to the invention will now be described by way of FIG. 39.

Figure 39:
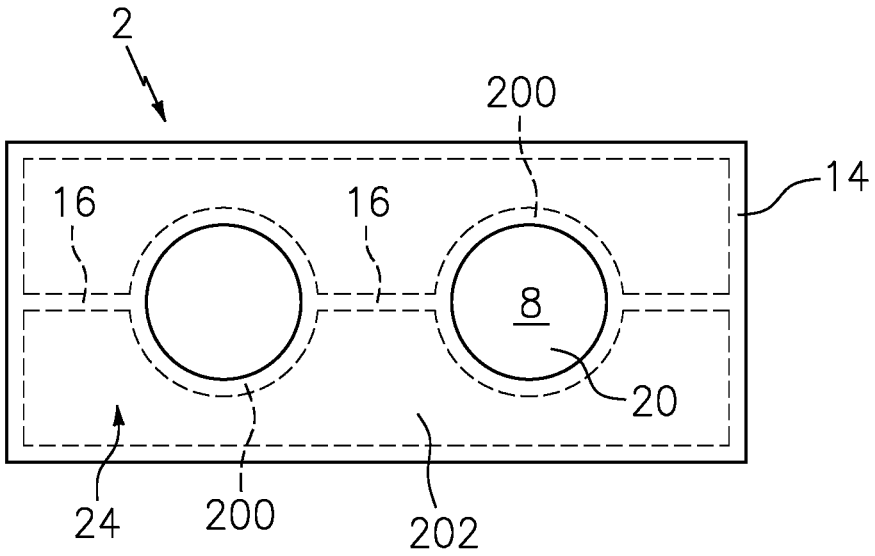
FIG. 39 shows a tenth embodiment of a formwork panel for concrete-work shutterings according to the invention in the form of a schematic plan view of the rear side of the formwork panel and the supporting structure of the same.

The formwork panel 2 illustrated in FIG. 39 is joined together from two constituent parts, namely a supporting structure 4 and a formwork skin 6 which in the instant case is constituted by a single formwork skin element 8. Both the supporting structure 4 and the formwork skin element 8 consist completely of plastics material in the present embodiment.

Each of the two longitudinal edges of the supporting structure 4 has the configuration of a wall 12, and each of the two transverse edges of the supporting structure 4 has the configuration of a wall 14. A longitudinal intermediate wall 16 extends approximately centrally from one transverse peripheral wall 12 to the other transverse peripheral wall 14 and, at two locations, splits into two semicircular arms 200 each. When taking together the two semicircular arms 200 at each of these two locations, a wall portion in the form of a full circle is constituted there which surrounds a circular opening 20. Each of the two openings 20 is continuous from the front side 22 to the rear side 24 of the supporting structure 4. At the locations without openings 20, the rear side of the supporting structure 4—with the exception of possible channels 34 and 42—is closed by a plate-like material portion 202. The confines of the walls 12, 14, 16 are partly shown in broken lines as they are located behind the plate-like material portion 202. There may be provided additional intermediate walls which may also extend differently, if desired; the number of the openings may be smaller or greater than two.

Differently from the preceding embodiments, the walls 12, 14, 16 in the tenth embodiment are not in the form of double walls, but as an alternative could be in the form of double walls.

For reasons of simplification, FIGS. 36 to 39 do not show how the supporting structure 4 and the formwork skin element 8 are connected to each other. In this regard, in particular those types of connection are feasible that have been illustrated and described in detail with respect to the preceding embodiments. The same applies for the design of the peripheral walls 12, 14 with wall openings 30 and the related division of the closing material portions 26 of the peripheral walls 12, 14 in sections, provided that the peripheral walls 12, 14 are double walls.

Also in the embodiments according to FIGS. 36 to 39, the respective supporting structure 4 as well as the respective formwork skin element 8 are each constituted by an integral injection-molded component of plastics material or an integral compression-molded component of plastics material, i.e. the supporting structure 4 as well as the formwork skin element 8 each have a configuration permitting manufacture thereof by plastics injection molding or plastics compression molding.

What is claimed is:

1. A formwork panel having a length, a width, and a thickness, comprising:

a supporting structure comprising a plastic material, the supporting structure having:

a first face side and a second face side, wherein the second face side is disposed opposite the first face side;

a first peripheral wall, a second peripheral wall, a third peripheral wall, and a fourth peripheral wall, each said peripheral wall extending in a thickness direction between the first face side and the second face side, and wherein the first, second, third, and fourth peripheral walls form a periphery of the supporting structure;

a plurality of first intermediate walls, spaced apart from one another and extending between the first peripheral wall and the second peripheral wall, and each said first intermediate wall extending in the thickness direction, and wherein at least one of said first intermediate walls has a double wall configuration defined by a pair of first side wall portions spaced apart from one another, and a material portion extending between the first side wall portions at the second face side, wherein the material portion closes the double wall configuration at the second face side, and the double wall configuration is open at the first face side;

a plurality of second intermediate walls, spaced apart from one another and extending between the third peripheral wall and the fourth peripheral wall, and each said second intermediate wall extending in the thickness direction;

wherein the plurality of first intermediate walls intersects with the plurality of second intermediate walls, thereby defining openings disposed between adjacent first intermediate walls and adjacent second intermediate walls, which openings extend between the first face side and the second face side; and at least one formwork skin comprising a plastic material, the formwork skin having a front side surface and a rear side surface, which rear side surface is opposite the front side surface, wherein the formwork skin is releasably attached to the supporting structure, with the formwork skin rear side surface facing the supporting structure first face side.

2. The formwork panel of claim 1, wherein each of the plurality of first intermediate walls has the double wall configuration.

3. The formwork panel of claim 1, wherein at least one of said second intermediate walls has a double wall configuration defined by a pair of second side wall portions spaced apart from one another, and a second material portion extending between the second side wall portions at the second face side, wherein the second material portion closes the double wall configuration at the second face side, and the double wall configuration is open at the first face side.

4. The formwork panel of claim 3, wherein each of the plurality of second intermediate walls has the double wall configuration.

5. The formwork panel of claim 1, wherein the supporting structure consists of a first type of plastics material having a first strength, and the formwork skin consists of a second type of plastics material having a second strength, wherein the first strength is greater than the second strength.

6. A formwork panel having a length, a width, and a thickness, comprising:

a supporting structure comprising a plastic material, the supporting structure having:

a first face side and a second face side, wherein the second face side is disposed opposite the first face side;

a first peripheral wall, a second peripheral wall, a third peripheral wall, and a fourth peripheral wall, each said peripheral wall extending in a thickness direction between the first face side and the second face side, and wherein the first, second, third, and fourth peripheral walls form a periphery of the supporting structure;

wherein at least one of the first peripheral wall, the second peripheral wall, the third peripheral wall and the fourth peripheral wall has a double wall configuration defined by a pair of side wall portions spaced apart from one another, and a plurality of material portions arranged in sections spaced apart from one another along a length of the respective peripheral wall and extending between the side wall portions at the second face side, wherein each said section closes the double wall configuration at the second face side, and the double wall configuration is open at the first face side;

a plurality of first intermediate walls, spaced apart from one another and extending between the first peripheral wall and the second peripheral wall, and each said first intermediate wall extending in the thickness direction;

a plurality of second intermediate walls, spaced apart from one another and extending between the third peripheral wall and the fourth peripheral wall, and each said second intermediate wall extending in the thickness direction;

wherein the plurality of first intermediate walls intersects with the plurality of second intermediate walls, thereby defining openings disposed between adjacent first intermediate walls and adjacent second intermediate walls, which openings extend between the first face side and the second face side; and at least one formwork skin comprising a plastic material, the formwork skin having a front side surface and a rear side surface, which rear side surface is opposite the front side surface, wherein the formwork skin is releasably attached to the supporting structure, with the formwork skin rear side surface facing the supporting structure first face side.

7. The formwork panel of claim 6, wherein each of said peripheral walls has the double wall configuration.

8. The formwork panel of claim 6, wherein at least one of said first intermediate walls has a double wall configuration defined by a pair of first side wall portions spaced apart from one another, and a material portion extending between the first side wall portions at the second face side, wherein the material portion closes the double wall configuration at the second face side, and the double wall configuration is open at the first face side.

9. The formwork panel of claim 6, wherein at least one of said second intermediate walls has a double wall configuration defined by a pair of second side wall portions spaced apart from one another, and a second material portion extending between the second side wall portions at the second face side, wherein the second material portion closes the double wall configuration at the second face side, and the double wall configuration is open at the first face side.

10. The formwork panel of claim 6, wherein the supporting structure consists of a first type of plastics material having a first strength, and the formwork skin consists of a second type of plastics material having a second strength, wherein the first strength is greater than the second strength.

11. A formwork panel having a length, a width, and a thickness, comprising:

a supporting structure comprising a plastic material, the supporting structure having:

a first face side and a second face side, wherein the second face side is disposed opposite the first face side;

a first peripheral wall, a second peripheral wall, a third peripheral wall, and a fourth peripheral wall, each said peripheral wall extending in a thickness direction between the first face side and the second face side, and wherein the first, second, third, and fourth peripheral walls form a periphery of the support structure;

wherein each peripheral wall has a double wall configuration defined by a pair of side wall portions spaced apart from one another, and a plurality of material portions arranged in sections spaced apart from one another along a length of the respective peripheral wall and extending between the side wall portions at the second face side, wherein each said section closes the double wall configuration at the second face side, and the double wall configuration is open at the first face side;

a plurality of first intermediate walls, spaced apart from one another and extending between the first peripheral wall and the second peripheral wall, and each said first intermediate wall extending in the thickness direction;

a plurality of second intermediate walls, spaced apart from one another and extending between the third peripheral wall and the fourth peripheral wall, and each said second intermediate wall extending in the thickness direction;

wherein the plurality of first intermediate walls intersects with the plurality of second intermediate walls; and wherein each peripheral wall includes a plurality of elongated wall openings defined by a length and a width, wherein the width is perpendicular to the length and the length is greater than the width, and the length extends in a lengthwise direction of the respective peripheral wall, and wherein each of the wall openings extends through the side wall portions of the respective peripheral wall, and each wall opening includes an opening circumferential wall that extends between the side wall portions of the respective peripheral wall; and at least one formwork skin comprising a plastic material, the formwork skin having a front side surface, a rear side surface, which rear side surface is opposite the front side surface, wherein the formwork skin is releasably attached to the supporting structure, with the formwork skin rear side surface facing the supporting structure first face side.

12. The formwork panel of claim 11, wherein each of the elongated wall openings has a first lengthwise end and a second lengthwise end and a central section extending between the first lengthwise end and the second lengthwise end, and the width is constant within the central section.

13. The formwork panel of claim 11, wherein at least one of said first intermediate walls has a double wall configuration defined by a pair of first side wall portions spaced apart from one another, and a material portion extending between the first side wall portions at the second face side, wherein the material portion closes the double wall configuration at the second face side, and the double wall configuration is open at the first face side.

14. The formwork panel of claim 11, wherein at least one of said second intermediate walls has a double wall configuration defined by a pair of second side wall portions spaced apart from one another, and a second material portion extending between the second side wall portions at the second face side, wherein the second material portion closes the double wall configuration at the second face side, and the double wall configuration is open at the first face side.

15. The formwork panel of claim 11, wherein the supporting structure consists of a first type of plastics material having a first strength, and the formwork skin consists of a second type of plastics material having a second strength, wherein the first strength is greater than the second strength.

16. The formwork panel of claim 11, wherein the first intermediate walls and the second intermediate walls define openings disposed between adjacent first intermediate walls and adjacent second intermediate walls, which openings extend between the first face side and the second face side.

* * * * *